US006305312B1

(12) United States Patent
Bent et al.

(10) Patent No.: US 6,305,312 B1
(45) Date of Patent: Oct. 23, 2001

(54) STACKABLE VERTICAL PANEL TRAFFIC CHANNELIZING DEVICE

(75) Inventors: Bruce C. Bent; James A. Bent, both of Huntington Beach, CA (US)

(73) Assignee: Bent Manufacturing Company, Huntington Beach, CA (US)

( * ) Notice: Subject to any disclaimer, the term of this patent is extended or adjusted under 35 U.S.C. 154(b) by 0 days.

(21) Appl. No.: 09/329,649

(22) Filed: Jun. 9, 1999

(51) Int. Cl.[7] ..... E01F 9/00

(52) U.S. Cl. ..... 116/63 P; 116/63 R

(58) Field of Search ..... 116/63 P, 63 C, 116/63 R, 63 T; 40/612; 404/6, 9; D10/109, 110, 111, 112, 113

(56) References Cited

U.S. PATENT DOCUMENTS

| | | | | |
|---|---|---|---|---|
| D. 60,293 | | 1/1922 | Meden . | |
| D. 235,744 | | 7/1975 | England | D10/109 |
| D. 243,073 | | 1/1977 | Kulp et al. | D10/109 |
| D. 243,074 | | 1/1977 | Kulp et al. | D10/109 |
| D. 243,075 | | 1/1977 | Kulp et al. | D10/109 |
| D. 272,809 | | 2/1984 | Bent et al. | D10/109 |
| D. 276,510 | | 11/1984 | Bent et al. | D10/109 |
| D. 279,275 | | 6/1985 | Cory | D10/109 |
| D. 309,585 | | 7/1990 | Kulp | D10/109 |
| D. 310,642 | | 9/1990 | Kulp | D10/109 |
| D. 315,269 | * | 3/1991 | Brazis | D6/551 |
| D. 320,172 | | 9/1991 | Thurston | D10/113 |
| D. 386,705 | | 11/1997 | Morgan | D10/113 |
| D. 412,131 | * | 7/1999 | Bent et al. | D10/113 |
| D. 415,443 | * | 10/1999 | Bent et al. | D10/113 |
| 196,889 | | 11/1877 | Gillham . | |
| 1,228,615 | | 6/1917 | Stafford . | |
| 1,939,968 | | 12/1933 | Frei | 189/23 |
| 2,103,410 | | 12/1937 | Frei | 189/23 |
| 2,378,750 | | 6/1945 | Carew | 229/1.5 |
| 2,448,413 | | 8/1948 | Borghesi | 248/194 |
| 2,456,685 | | 12/1948 | Delmotte | 177/329 |
| 2,483,734 | | 10/1949 | Neal | 40/125 |
| 2,564,145 | | 8/1951 | Beall et al. | 177/329 |
| 2,628,587 | | 2/1953 | Peters et al. | 116/63 |
| 2,649,803 | | 8/1953 | Andre | 46/25 |
| 2,762,327 | | 9/1956 | Weig | 116/63 |
| 2,762,328 | | 9/1956 | Weig | 116/63 |
| 2,808,803 | | 10/1957 | Weig | 116/63 |

(List continued on next page.)

FOREIGN PATENT DOCUMENTS

| | | | |
|---|---|---|---|
| 216329 | 6/1956 | (AU) | 116/63 |
| 2 233 994 | 2/1974 | (DE) . | |
| 2 580 050 | 10/1986 | (FR) . | |
| 665785 | 1/1952 | (GB) | 116/63 |
| 1058881 | 2/1967 | (GB) . | |
| 1 301 084 | 12/1972 | (GB) . | |
| 2 077 332 | 5/1981 | (GB) . | |
| 2 090 313 | 12/1981 | (GB) . | |
| 2 081 348 | 2/1982 | (GB) . | |
| 2 101 180 | 1/1983 | (GB) . | |
| 2 122 239 | 5/1983 | (GB) . | |
| 2 156 409 | 3/1984 | (GB) . | |
| 2 182 701 | 10/1986 | (GB) . | |

*Primary Examiner*—Kien T. Nguyen
*Assistant Examiner*—Faye Francis
(74) *Attorney, Agent, or Firm*—J. Harrison Colter

(57) ABSTRACT

A flat panel vertical traffic channelizer includes front and back generally rectangular panels connected to generally triangular end panels by curved corners. Each of the curved corners is formed as a portion of a cone, with a gradually increasing radius from top to bottom. The curved corners are preferably of a shape that would form a cone if the rectangular panels and triangular end panels were removed. Alternatively, the end panels may be reduced or omitted, so that the flat panels are connected by curved corners that have a radius that gradually increases from the top to the bottom of the channelizer.

17 Claims, 19 Drawing Sheets

U.S. PATENT DOCUMENTS

| | | | | |
|---|---|---|---|---|
| 2,817,308 | | 12/1957 | Scanlon | 116/63 |
| 2,843,347 | | 7/1958 | King | 248/44 |
| 2,942,571 | | 6/1960 | White | 116/63 |
| 2,957,444 | | 10/1960 | Boettler | 116/63 |
| 2,977,864 | | 4/1961 | Pullar | 94/22 |
| 3,099,244 | | 7/1963 | Knapp | 116/63 |
| 3,119,588 | | 1/1964 | Keats | 248/158 |
| 3,231,994 | | 2/1966 | Cyrus | 40/125 |
| 3,380,428 | | 4/1968 | Abrams | 116/63 |
| 3,451,368 | | 6/1969 | Keats | 116/63 |
| 3,471,114 | | 10/1969 | Ball | 248/346 |
| 3,499,413 | | 3/1970 | Heard | 116/63 |
| 3,520,235 | | 7/1970 | Palazzolo | 94/1.5 |
| 3,563,445 | | 2/1971 | Fairport | 229/25 |
| 3,591,144 | | 7/1971 | Iving | 256/13.1 |
| 3,618,556 | | 11/1971 | Dittrich | 116/63 |
| 3,619,443 | | 11/1971 | Feldman | 264/89 |
| 3,644,618 | | 2/1972 | Krueger | 248/44 |
| 3,660,817 | * | 5/1972 | Abrams | 340/908 |
| 3,664,085 | | 5/1972 | Rousseau et al. | 53/112 |
| 3,675,811 | | 7/1972 | Artz | 220/20 |
| 3,701,456 | | 10/1972 | Alroy | 220/97 |
| 3,732,842 | | 5/1973 | Vara, Sr. | 116/63 |
| 3,738,309 | | 6/1973 | Nichol | 116/63 |
| 3,751,852 | | 8/1973 | Schrepper | 47/34 |
| 3,794,090 | | 2/1974 | Commisso | 150/0.05 |
| 3,809,007 | | 5/1974 | Brown | 116/63 |
| 3,822,668 | | 7/1974 | Schradieck | 116/63 |
| 3,825,114 | | 7/1974 | Johnson et al. | 206/507 |
| 3,846,935 | | 11/1974 | Wagner | 47/26 |
| 3,913,518 | | 10/1975 | Kaplan | 116/63 |
| 3,916,816 | | 11/1975 | Fitch | 116/63 |
| 3,949,701 | | 4/1976 | Teixeira | 116/63 |
| 3,950,208 | | 4/1976 | Pavuk et al. | 264/156 |
| 3,952,690 | | 4/1976 | Rizzo et al. | 116/63 |
| 4,006,702 | | 2/1977 | St. Cyr | 116/63 |
| 4,007,919 | | 2/1977 | Totten | 256/59 |
| 4,019,271 | | 4/1977 | Latimer | 40/125 |
| 4,026,086 | | 5/1977 | Langley | 52/582 |
| 4,040,759 | | 8/1977 | Skalle | 404/6 |
| 4,053,100 | | 10/1977 | Baptist | 229/43 |
| 4,054,207 | | 10/1977 | Lazure et al. | 206/486 |
| 4,071,224 | | 1/1978 | Gilbert | 256/64 |
| 4,083,033 | | 4/1978 | Kulp et al. | 340/114 |
| 4,102,453 | | 7/1978 | Carroll et al. | 206/507 |
| 4,102,454 | | 7/1978 | Karevaara | 206/514 |
| 4,120,398 | | 10/1978 | Braddon et al. | 206/408 |
| 4,134,533 | | 1/1979 | Heavner | 229/34 |
| 4,145,044 | | 3/1979 | Wilson et al. | 273/1.5 R |
| 4,175,661 | | 11/1979 | Barnes | 206/519 |
| 4,184,604 | | 1/1980 | Amberg et al. | 220/254 |
| 4,187,647 | | 2/1980 | Hall | 52/20 |
| 4,188,151 | | 2/1980 | Hall | 404/26 |
| 4,197,808 | | 4/1980 | Kinninger | 116/63 |
| 4,201,975 | | 5/1980 | Marcus | 340/84 |
| 4,239,137 | | 12/1980 | Arcoutte | 224/319 |
| 4,256,050 | | 3/1981 | Barnard | 116/63 |
| 4,289,419 | | 9/1981 | Young et al. | 404/6 |
| 4,291,830 | | 9/1981 | Sorensen | 229/45 R |
| 4,298,186 | | 11/1981 | Glass | 256/64 |
| 4,303,349 | | 12/1981 | Upton | 404/6 |
| 4,312,600 | | 1/1982 | Schaaf et al. | 404/6 |
| 4,317,617 | | 3/1982 | Charlton | 350/97 |
| 4,329,800 | | 5/1982 | Shuman | 40/606 |
| 4,334,616 | | 6/1982 | Wilson | 206/505 |
| 4,348,133 | | 9/1982 | Trent et al. | 404/6 |
| 4,349,147 | | 9/1982 | Jensen | 229/34 |
| 4,412,644 | | 11/1983 | La Fever | 229/1.5 |
| 4,418,863 | | 12/1983 | Kimbrell, Sr. | 229/49 |
| 4,441,600 | | 4/1984 | Caray | 192/89 B |
| 4,441,615 | | 4/1984 | Goodrich | 206/511 |
| 4,466,376 | | 8/1984 | Wells | 116/63 |
| 4,475,101 | | 10/1984 | Kulp et al. | 340/114 |
| 4,511,281 | | 4/1985 | Schmanski | 404/10 |
| 4,516,109 | | 5/1985 | Thurston | 340/114 |
| 4,520,928 | | 6/1985 | Wilson | 206/505 |
| 4,570,798 | | 2/1986 | Wilson | 206/505 |
| 4,573,109 | * | 2/1986 | Lack | 404/6 |
| 4,596,489 | | 6/1986 | Mariol et al. | 404/10 |
| 4,611,949 | | 9/1986 | Schmanski | 404/9 |
| 4,624,210 | | 11/1986 | Glass | 116/63 |
| 4,674,431 | | 6/1987 | Cory | 116/63 |
| 4,688,766 | | 8/1987 | Zucker | 256/13.1 |
| 4,710,053 | | 12/1987 | Kulp et al. | 404/9 |
| 4,772,869 | | 9/1988 | Grammas et al. | 340/114 |
| 4,782,783 | | 11/1988 | Kulp et al. | 116/63 |
| 4,792,258 | | 12/1988 | Goff | 404/6 |
| 4,798,017 | | 1/1989 | Giotis | 40/612 |
| 4,852,511 | | 8/1989 | Look et al. | 116/63 |
| 4,859,983 | | 8/1989 | Kulp et al. | 340/908.1 |
| 4,925,334 | | 5/1990 | Beard | 404/9 |
| 4,973,190 | | 11/1990 | Erwin et al. | 404/10 |
| 5,003,912 | | 4/1991 | Thurston | 116/63 |
| 5,009,541 | | 4/1991 | Thurston | 404/6 |
| 5,024,435 | | 6/1991 | Robbins | 273/26 |
| 5,026,204 | | 6/1991 | Kulp et al. | 404/10 |
| 5,036,791 | | 8/1991 | Thurston | 116/63 |
| 5,046,885 | | 9/1991 | Thurston | 404/10 |
| 5,054,955 | | 10/1991 | Habernig | 404/10 |
| 5,103,616 | | 4/1992 | Nordberg | 52/585 |
| 5,161,783 | | 11/1992 | German | 256/19 |
| 5,165,818 | | 11/1992 | Newhart | 404/10 |
| 5,168,827 | | 12/1992 | Junker | 116/63 |
| 5,195,453 | | 3/1993 | McGibbon, II | 116/63 |
| 5,199,813 | | 4/1993 | Nagler | 404/9 |
| 5,199,814 | | 4/1993 | Clark et al. | 404/10 |
| 5,201,599 | | 4/1993 | Kulp et al. | 404/6 |
| 5,220,740 | | 6/1993 | Brault | 40/606 |
| 5,234,280 | | 8/1993 | Cowan | 404/6 |
| 5,287,822 | | 2/1994 | Anderson | 116/63 |
| 5,306,106 | | 4/1994 | Mileti | 404/6 |
| 5,354,031 | | 10/1994 | Bilotti | 248/519 |
| 5,387,049 | | 2/1995 | Duckett | 404/6 |
| 5,446,984 | | 9/1995 | Kulp et al. | 40/610 |
| 5,451,118 | | 9/1995 | Wilkins et al. | 404/6 |
| 5,458,434 | | 10/1995 | Bent et al. | 404/6 |
| 5,481,835 | | 1/1996 | Bloom | 52/98 |
| 5,482,270 | | 1/1996 | Smith | 273/72 |
| 5,484,225 | | 1/1996 | Warner | 404/9 |
| 5,540,007 | | 7/1996 | Kulp et al. | 40/610 |
| 5,560,732 | | 10/1996 | Kulp et al. | 404/10 |
| 5,577,824 | | 11/1996 | Wright | 340/908.1 |
| 5,722,788 | | 3/1998 | Bent et al. | 404/6 |
| 5,735,632 | * | 4/1998 | Braverman | 404/6 |
| 5,749,673 | | 5/1998 | Kulp et al. | 404/10 |
| 5,755,528 | | 5/1998 | Kulp et al. | 404/6 |
| 5,772,357 | | 6/1998 | Evans | 404/7 |
| 5,860,237 | | 1/1999 | Johnson | 40/603 |
| 5,868,520 | | 2/1999 | Kulp et al. | 404/6 |

* cited by examiner 110
110
110
122
120
114
116
118
138
139
100
104
136
138
139
140
166
106
154
150
166

STACKABLE VERTICAL PANEL TRAFFIC CHANNELIZING DEVICE

BACKGROUND OF THE INVENTION

This invention relates generally to traffic channelizing apparatus, and more particularly to a stackable flat panel traffic channelizing device having a handle on top.

The development of plastic traffic delineators, such as plastic barricades, cylinders, cones and barrels, for directing and channeling traffic flows has significantly increased the safety of automotive transportation. If an automobile strikes a wood or metal delineator, the occupants may be seriously injured and the automobile and the delineator may be seriously damaged. If a vehicle strikes a plastic delineator, the relatively lightweight, collapsible delineator causes little damage to the vehicle, and is significantly less likely to injure the vehicle occupants. Plastic delineators are also sufficiently resilient to withstand numerous hits from vehicles without being seriously damaged.

For ease of manufacture and use, plastic barricades have previously been made in two identical pieces that are hinged together. To assemble the barricade, one of the pieces is rotated about its lengthwise axis and matched to the other piece. Bolts are typically used to hinge the two pieces together.

These prior plastic barricades have certain disadvantages. For instance, barricades often need to be transported to different construction sites. Ideally, the barricade is easily stacked during transport to reduce the volume required for transport. In the past, stacking has required that the barricades be collapsed and stacked on top of each other, similar to a deck of cards.

Because the plastic is smooth, stacked plastic barricades have a tendency to slide off. To solve that problem, stacking lugs have been added to faces of the barricades, see, for instance, the barricade depicted in U.S. Pat. No. 5,003,912, the disclosure of which is incorporated herein by this reference. Such stacking lugs complicate the manufacture of the barricades, require additional material and slow the stacking process because workers need to align the lugs with the corresponding holes that receive the lugs. Furthermore, the lugs often were crushed and sometimes interfered with mounting of a sign on the flat panel of the barricade.

Another disadvantage of the prior barricades is the relative cost involved with constructing a barricade. That is, the two identical sides had to be bolted together, which required time and effort during manufacture. Also, the prior plastic barricades were relatively heavy, even if constructed of lightweight plastic.

In contrast, plastic cylindrical or conical traffic delineators have many advantages, including relative ease of manufacturing and light weight. However, cylindrical and conical delineators and cones do not have wide, flat panels for placement of signs or for increasing the surface area, and therefore the visibility, of the delineator. Thus, such delineators are not useful for mounting signs.

One attempt to increase the surface area of a sign on a conical delineator is depicted in U.S. Pat. No. 5,749,673, the disclosure of which is incorporated herein by this reference. As shown in that patent, flexible sheets of plastic are affixed to opposing sides of the conical walls. The conical delineator remains stackable, because the flexible plastic sheets bend around the conical wall when a second conical delineator is stacked on the first. However, such delineators require workers to rivet the plastic panels to the walls of the delineator, and do not stack as efficiently as would be desirable. Furthermore, after continued use and stacking, the flat panels, which are typically made of polyethylene sheeting or other plastic, cease to remain flat but rather will begin to curve around the delineator wall. This reduces the visible surface area of the delineator.

SUMMARY OF THE INVENTION

According to the present invention, a flat panel vertical traffic channelizer is provided that overcomes these and other drawbacks of the prior delineators. A channelizer made according to the present invention is a unitary piece of plastic that does not require any assembly, thereby reducing the cost of manufacture. The channelizer also stacks and unstacks easily, and includes a large flat panel for attaching signs.

A flat panel vertical traffic channelizer according to the present invention is preferably formed from blow molded plastic. The shape is similar to that of a cross between a cone and a barricade, that is, if the flat panels forming the sides of the channelizer were removed, the corners of the channelizer would generally form a cone, frustum or conic section. The walls of the channelizer are preferably of a defined thickness to reduce the weight of the channelizer and prevent "locking" of the channelizer when stacked, but maintain the strength and durability of the channelizer.

The channelizer according to the present invention comprises two flat panels having at least the minimum surface area set by state or federal regulation. Each panel forms a wall of the channelizer. One or more handles are formed on the top of the channelizer. The handle or handles are formed of a loop of plastic large enough for a hand to be inserted through the loop. When two or more channelizers are stacked, a deck formed in the inner surface of the upper stacked channelizer strikes the upper surface of the handle or handles, thereby preventing the panels from engaging and reducing lock-up of the stacked channelizers.

BRIEF DESCRIPTION OF THE DRAWINGS

Other features and advantages of the present invention will be apparent from the following Detailed Description taken in conjunction with the accompanying Drawings, in which.

DETAILED DESCRIPTION

Figure 1:
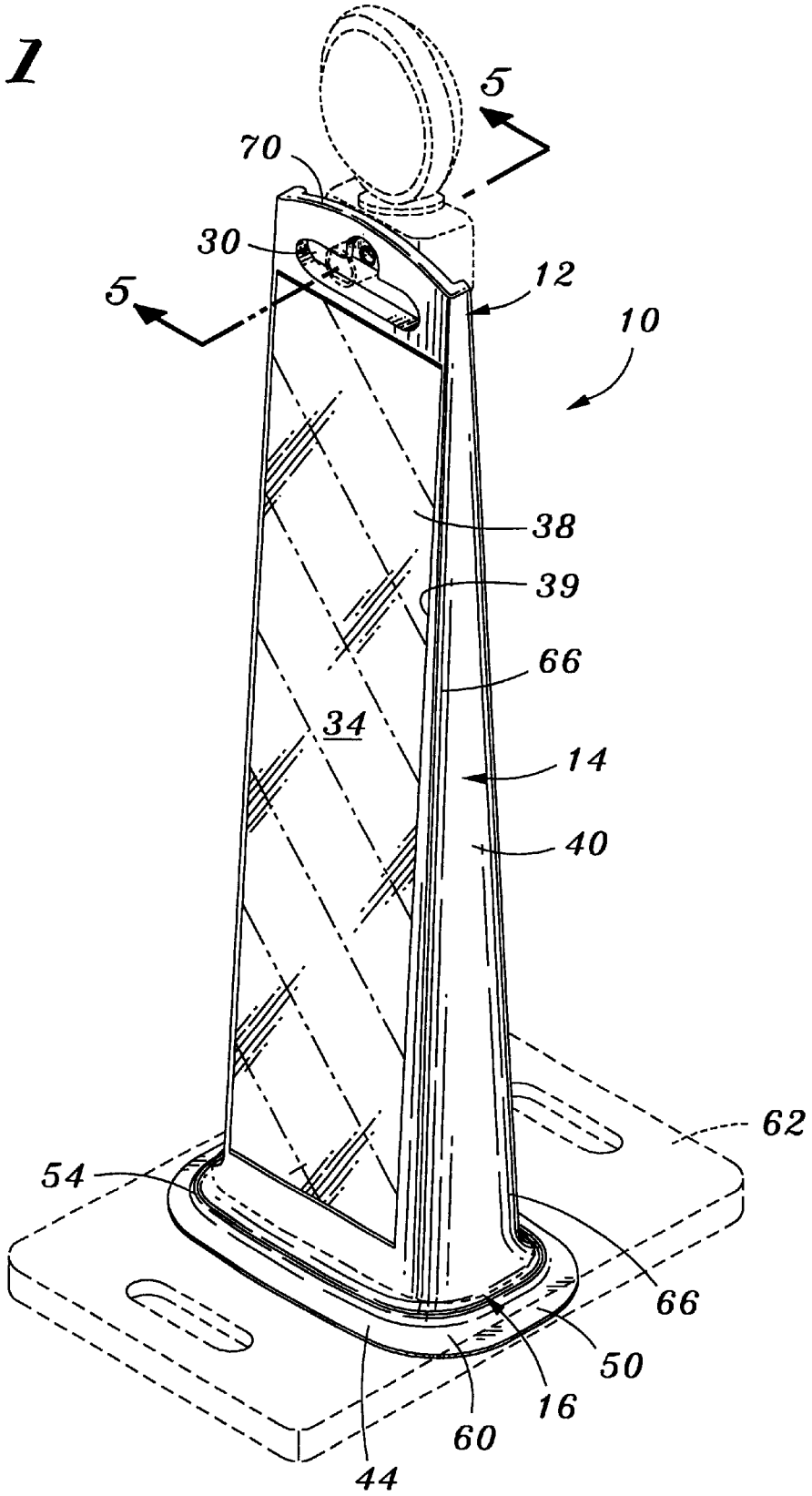
FIG. 1 is a perspective view of a first side of a stackable flat panel traffic channelizing device according to one embodiment of the present invention.

As shown in the drawings, the present invention is embodied in a flat panel traffic channelizing device 10. The channelizer 10 is hollow to reduce weight, reduce the quantity of material used, and to allow stacking of numerous channelizers. The channelizer 10 may be made of different materials and in various colors, including those most common in the traffic delineation industry. The channelizer is preferably formed by blow molding and subsequent trimming of light weight, resilient plastic, and may include pigments for the desired color, ultraviolet light inhibitors, stabilizers and fillers. In the first embodiment of the present invention depicted in FIGS. 1–11, the channelizer 10 comprises an upper end 12, a hollow body 14, and a bottom 16 that opens into a central cavity 18 formed by the body 14.

Figure 2:
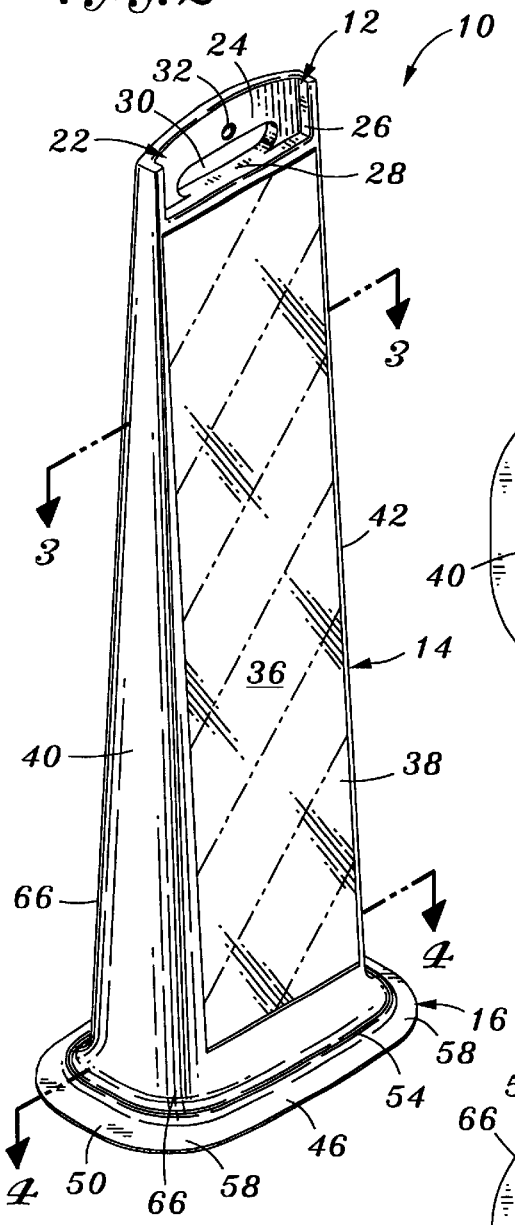
FIG. 2 is a perspective view of a second side view of the channelizing device of FIG. 1.
Figure 3:
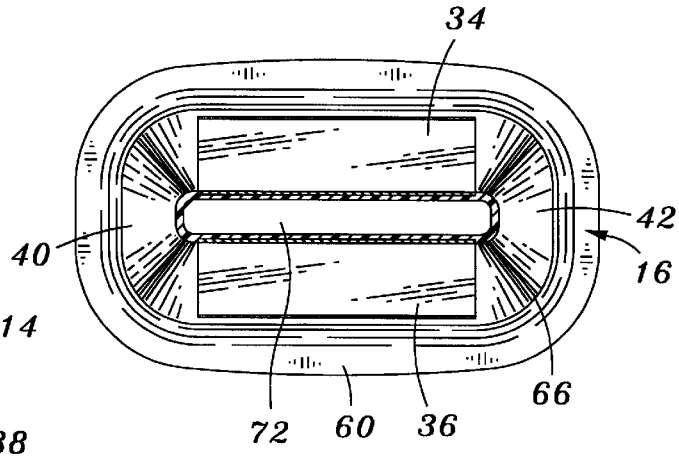
FIG. 3 is a cross-sectional view of the channelizing device of FIG. 1 taken along the line 3—3 of FIG. 2.
Figure 4:
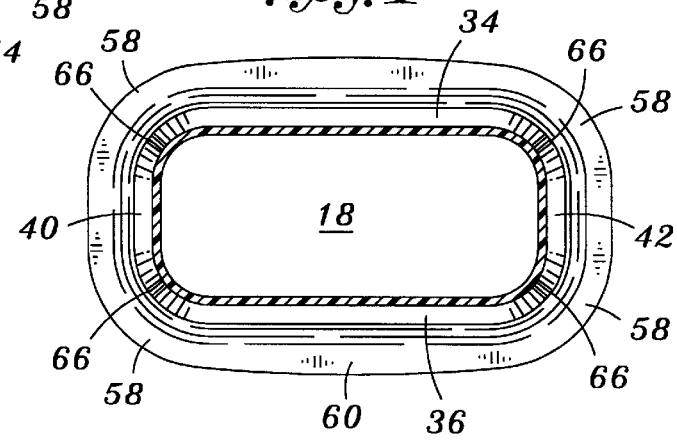
FIG. 4 is a cross-sectional view of the channelizing device of FIG. 1 taken along the line 4—4 of FIG. 2.
Figure 5:
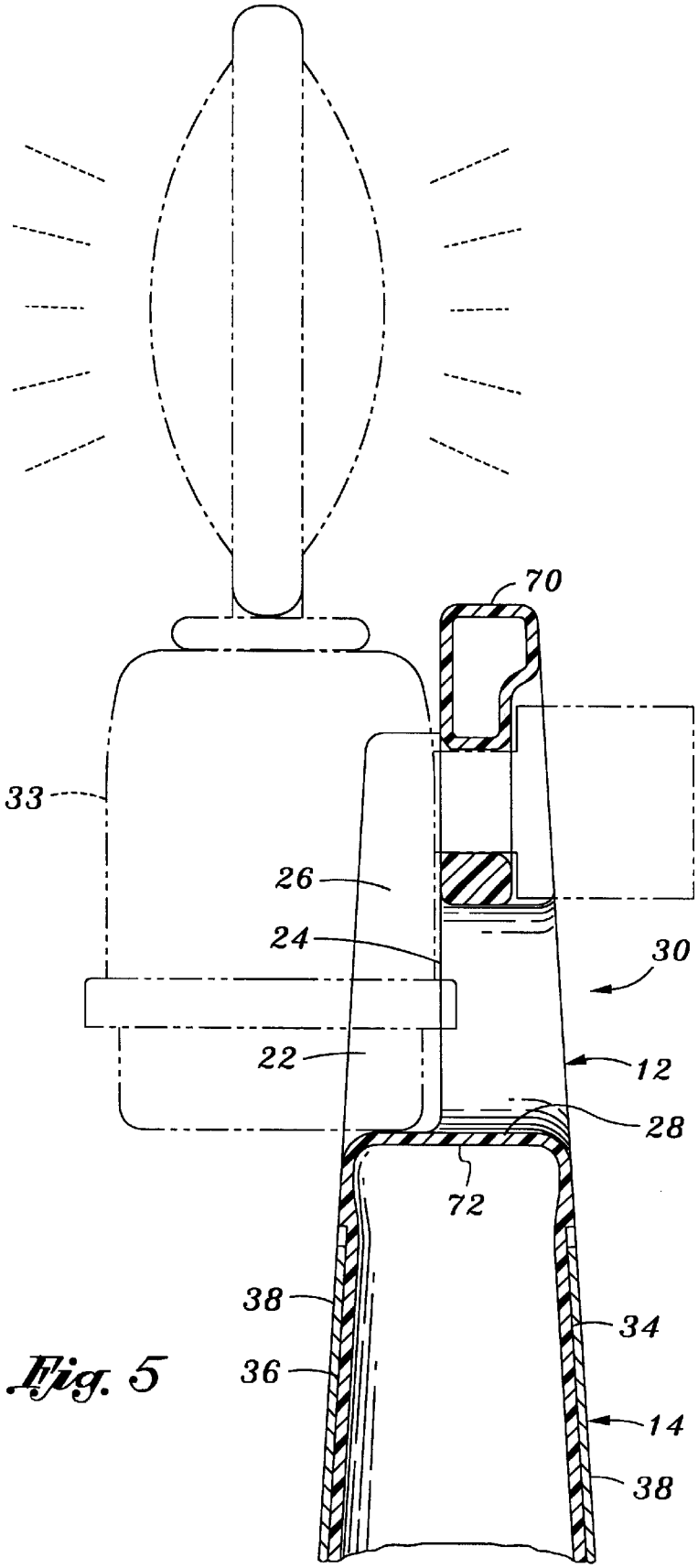
FIG. 5 is a cross-sectional view of the channelizing device of FIG. 1 taken along the line 5—5 of FIG. 1.
Figure 6:
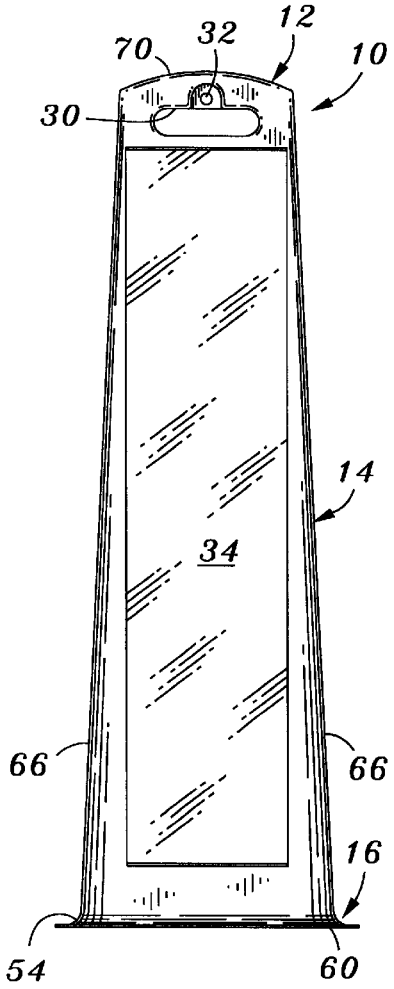
FIG. 6 is a first side elevation view of the channelizing device of FIG. 1.
Figure 31:
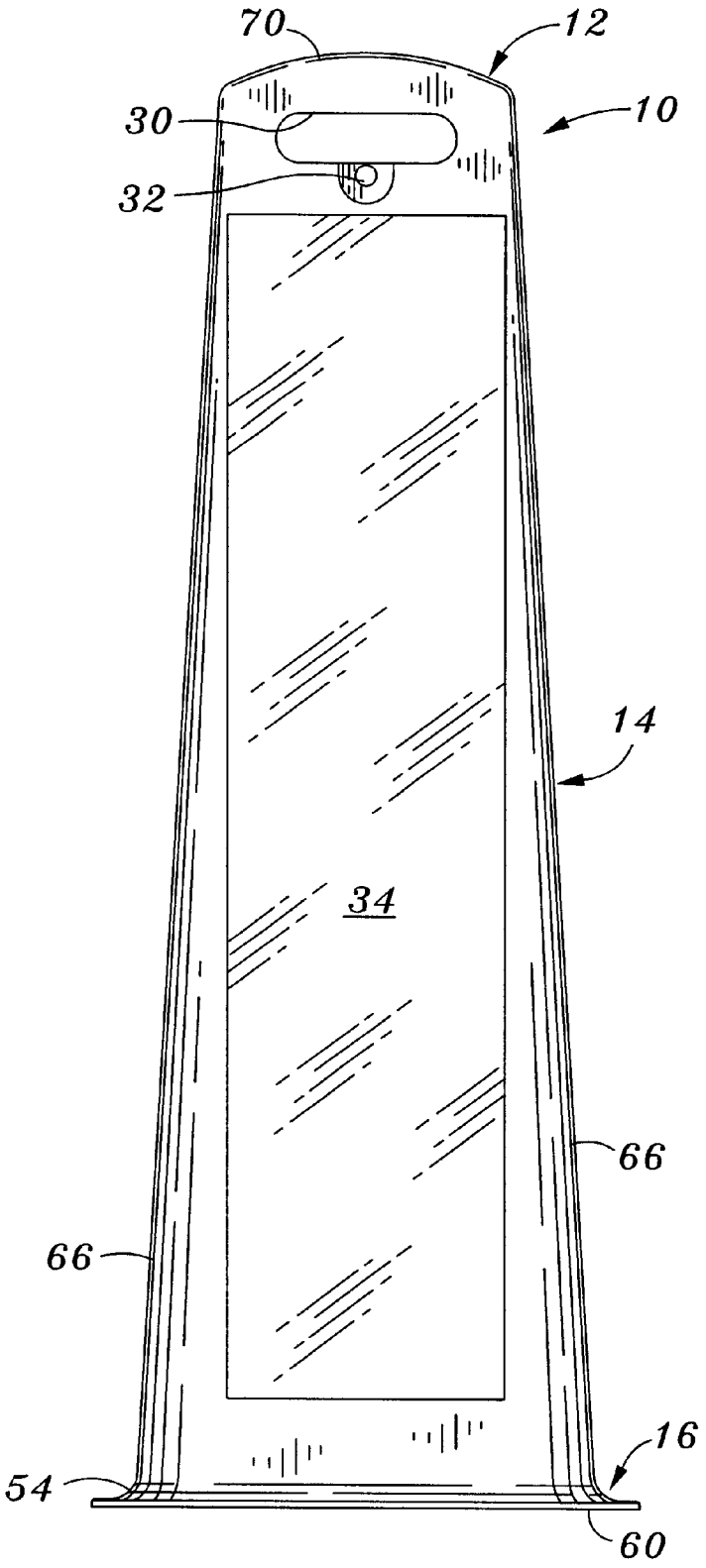
FIG. 31 is a perspective view of a first side of a stackable flat panel traffic channelizing device according to a fourth embodiment of the present invention.

As perhaps best depicted in FIG. 2, the upper end 12 has a closed top, so there is little need for trimming or cutting during manufacture. The upper end 12 of the channelizer 10 includes a bracket 22. A flat side wall 24, two end side walls 26, and a deck 28 form the bracket at the lower part of the upper end. A loop handle 30 is formed in the flat side wall 24, near the top of the channelizer 10, and a bolt hole 32 is formed above the loop handle. The loop handle 30 and the bolt hole 32 may be compression molded into the upper end 12, or may be cut out of the upper end after molding, preferably by incorporating a divot into the mold where the loop handle and the bolt hole are to be placed. The bolt hole is preferably formed above the handle so that the channelizers stack with a maximum of overlap, resulting in more efficient stacking, see FIG. 9. However, the bolt hole may also be formed below the loop handle, as depicted in FIG. 31.

As depicted in FIG. 1, the bracket 22 is of a size to permit mounting of a warning light 33 on the top of the channelizer 10. A bolt may be passed through the bolt hole 32 to hold the warning light on the flat side wall 24 of the channelizer 10. The two end side walls 26 and the deck 28 prevent the warning light from rotating, thereby keeping the light above the channelizer 10, as perhaps best depicted in FIG. 5.

The upper end 12 extends into the body 14 of the channelizer 10. The body 14 comprises a first side flat panel 34 that is connected to a second side flat panel 36 by two end panels 40 and 42. Each of the flat panels 34 and 36 is adapted to receive signage or retroreflective sheeting 38, such as in recessed areas 39, and each has the surface area required by state and federal regulations for flat panel displays, which is often 270 square inches. The flat panels 34 and 36 are generally rectangular in shape. The end panels 40 and 42, however, taper from being wide at the bottom to being narrow at the top, and thus are somewhat triangular in shape.

The body 14 extends into the bottom 16. The generally rectangular bottom 16 is formed of elongated sides 44 and 46 below the flat panels 34 and 36 and shorter sides 50 and 52 below the end panels 40 and 42. A transition section 54 having a radially inwardly curved wall extends around the circumference of the channelizer. Below the transition section the sides 44, 46, 50 and 52 flare outwardly near the lower end of the channelizer 10 to form a road surface engaging portion with rounded outer corners 58 and a flat bottom surface 60. The flaring sides hold the channelizer 10 under a base 62 that may be placed over the channelizer 10, as is known in the art.

Figure 12:
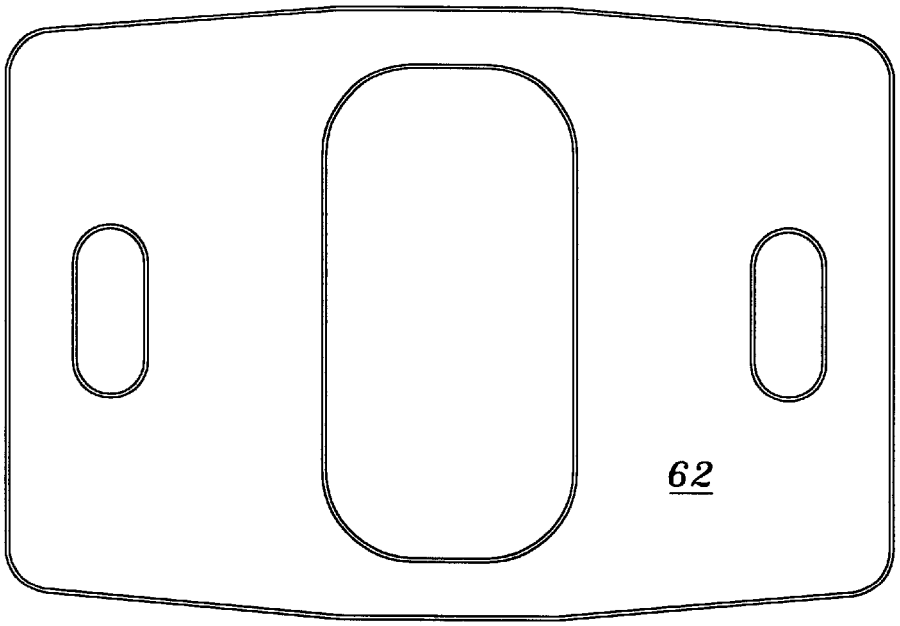
FIG. 12 is a top view of a first drop-over base that may be placed on a channelizing device of FIG. 1 to provide ballast to the device.
Figure 13:
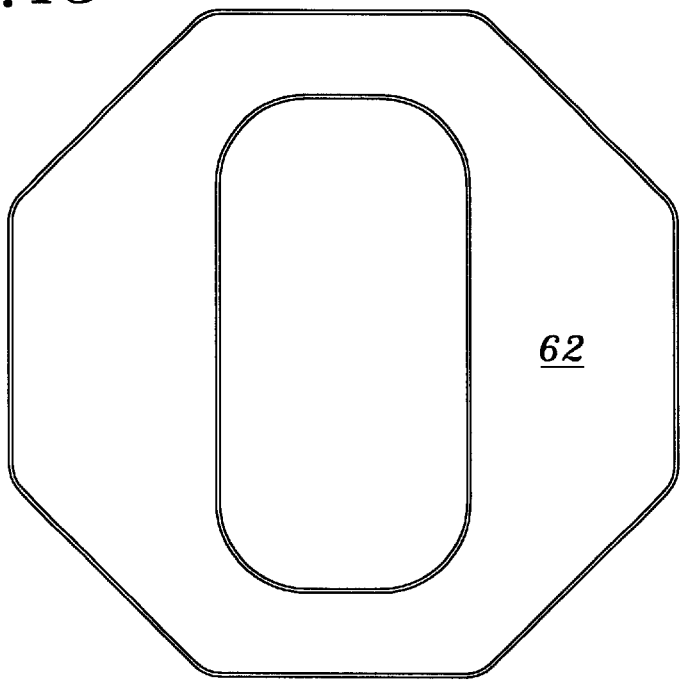
FIG. 13 is a top view of a second drop-over base that may be placed on a channelizing device of FIG. 1 to provide ballast to the device.

The base 62 may be made as is known in the art. The base has an opening of a size and shape to drop over the channelizer 10 and leave the flared portions of the bottom 16 under the base with the majority of the channelizer extending up above the base when in use. The base is relatively heavy and also low to the ground. The base has a bottom surface that is adapted to rest on the road surface and the top of the base is usually flat for ease of stacking. Two embodiments of the base 62 are depicted in FIGS. 12 and 13. In some embodiments, the base 62 is made of molded rubber, recycled automobile tires, or another high density molded material. In other embodiments, the base 62 is made of light weight plastic, and may be designed to accept ballast, as is known in the art.

The flat panels 34 and 36 on the body 14 of the present invention are connected to the end panels 40 and 42 by curved corners 66. Each of these curved corners 66 is basically a quarter of a conical section; that is, if the flat panels 34 and 36 and the end panels 40 and 42 were carefully cut out, the remaining curved corners 66 could be placed together to form a cone or, more accurately, a frustum because the cone would not end in a point. The curved corners graduate from a small radius at the top to a large radius at the bottom. In a preferred embodiment of the invention, the radius graduates from a 0.25 inch radius at the top to a four inch radius at the bottom.

As a result, when the channelizer 10 is crushed, for instance when hit by an automobile, the channelizer rebounds into proper shape easily. However, unlike prior cones that had panels affixed to the wall of the cone, the present channelizer is unitary, so there are no panels that could be torn off and no metal rivets holding the panels to the cone. Thus, the present invention is both less costly to manufacture and more durable, yet stacks as easily as a cone.

Figure 7:
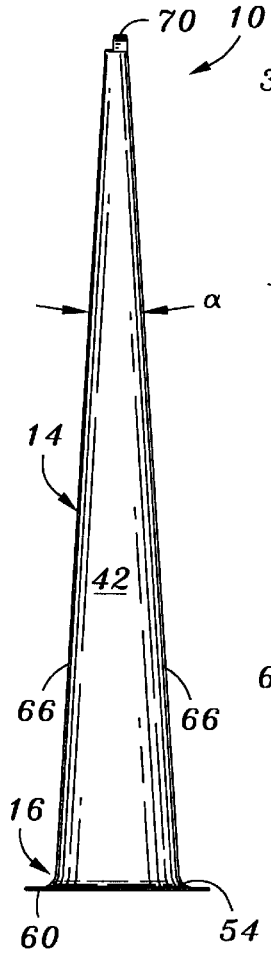
FIG. 7 is an end elevation view of the channelizing device of FIG. 1.
Figure 8:
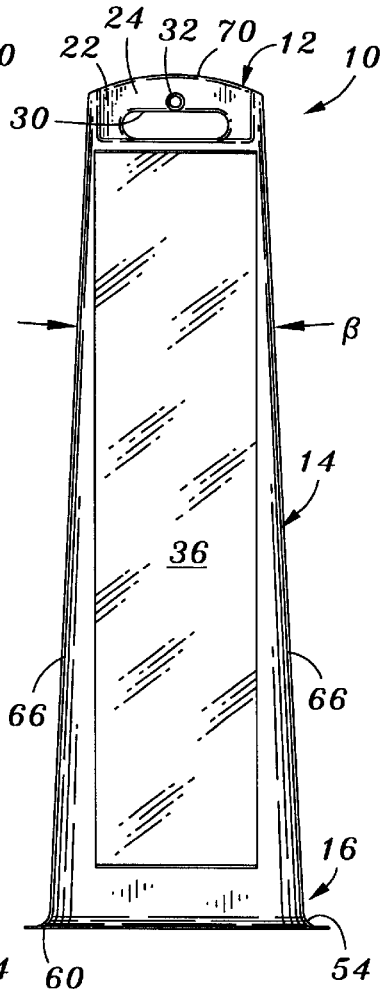
FIG. 8 is a second side elevation view of the channelizing device of FIG. 1.

Because of the conical nature of the curved corners 66, the end panels 40 and 42 have a narrow width near the upper end 12 of the channelizer 10 and a wider width near the bottom 16 of the channelizer 10. This increasing width of the end panels means that the flat panels 34 and 36 are held apart at an angle $\alpha$, as depicted in FIG. 7. It is presently believed that this angle a is critical to stacking of the channelizers.

Figure 9:
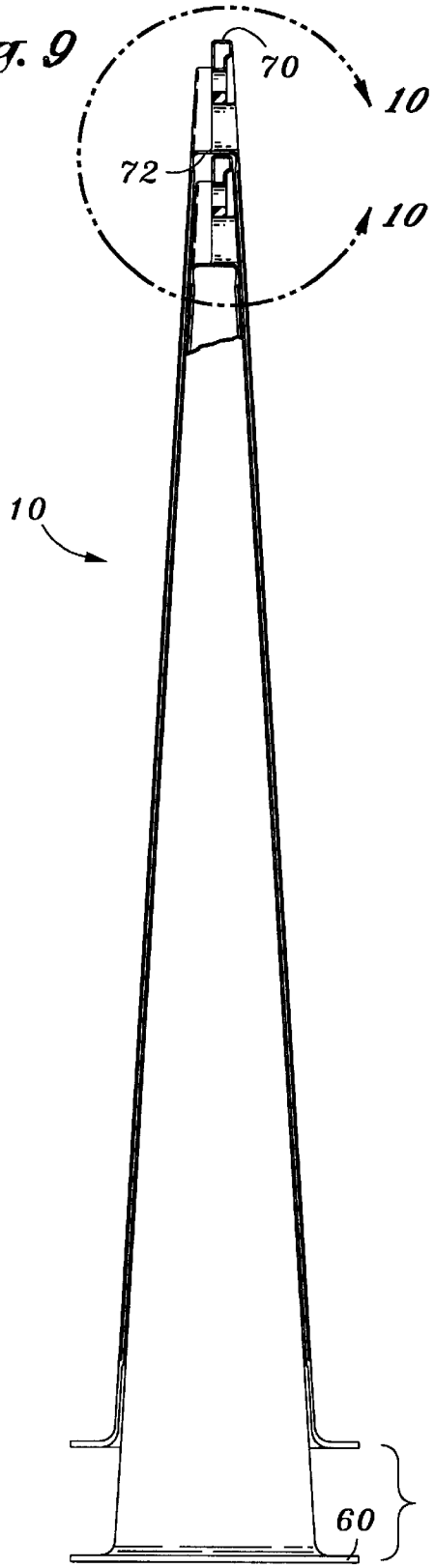
FIG. 9 is a cross-sectional view showing the stacking of two channelizing devices of FIG. 1.
Figure 10:
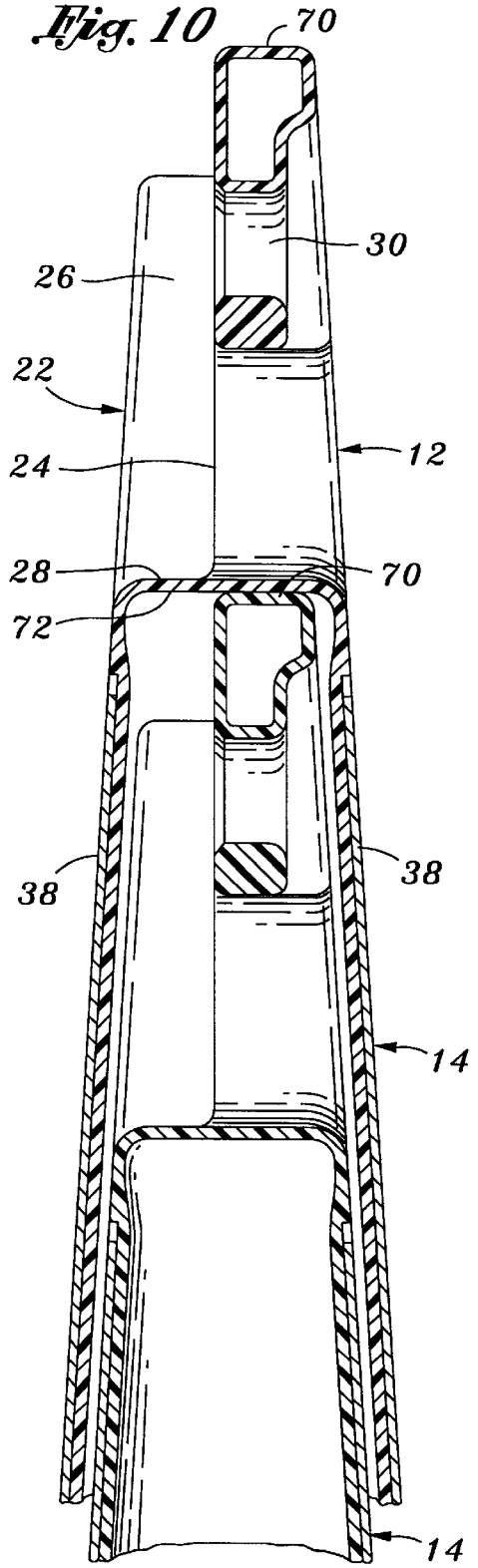
FIG. 10 is a cross-sectional view of the upper ends of two stacked channelizing devices of FIG. 1 taken along the line 10—10 of FIG. 9.

Stacking of the channelizer 10 according to the present invention is best depicted in FIGS. 9 and 10. As shown therein, when one channelizer 10 is stacked unto another channelizer, the top wall 70 of the upper end 12 of the channelizer on the bottom strikes the interior wall 72 of the deck 28 of the channelizer on the top. The interior surfaces of the flat panels 34 and 36 of the channelizer on top do not rest on the outer surfaces of the flat panels 34 and 36 of the channelizer on the bottom because the angle $\alpha$ is just enough to keep those flat panel surfaces, including the interior walls of the recessed areas 39, apart.

The angle $\alpha$ may be critical to the design of the present invention, but must be adjusted depending on the thickness of the walls and the required height of the channelizer 10. If the angle $\alpha$ is too small or the wall thickness too great, when two channelizers 10 are stacked they may jam together and "lock" the stacked channelizers. That is, the upper surfaces of the flat panel surfaces 34 and 36 of the lower stacked channelizer 10 will engage with the lower surfaces of the flat panel surfaces 34 and 36 of the upper stacked channelizer 10. This engagement causes the channelizers to stick together, making it very difficult to unstack the channelizers because of the narrow angle $\alpha$ and the increased weight of a thicker wall. However, if the wall thickness is too thin, the channelizer lacks sufficient strength and durability. If the angle $\alpha$ is too large, the channelizers will not stack in a minimum of space.

Figure 11:
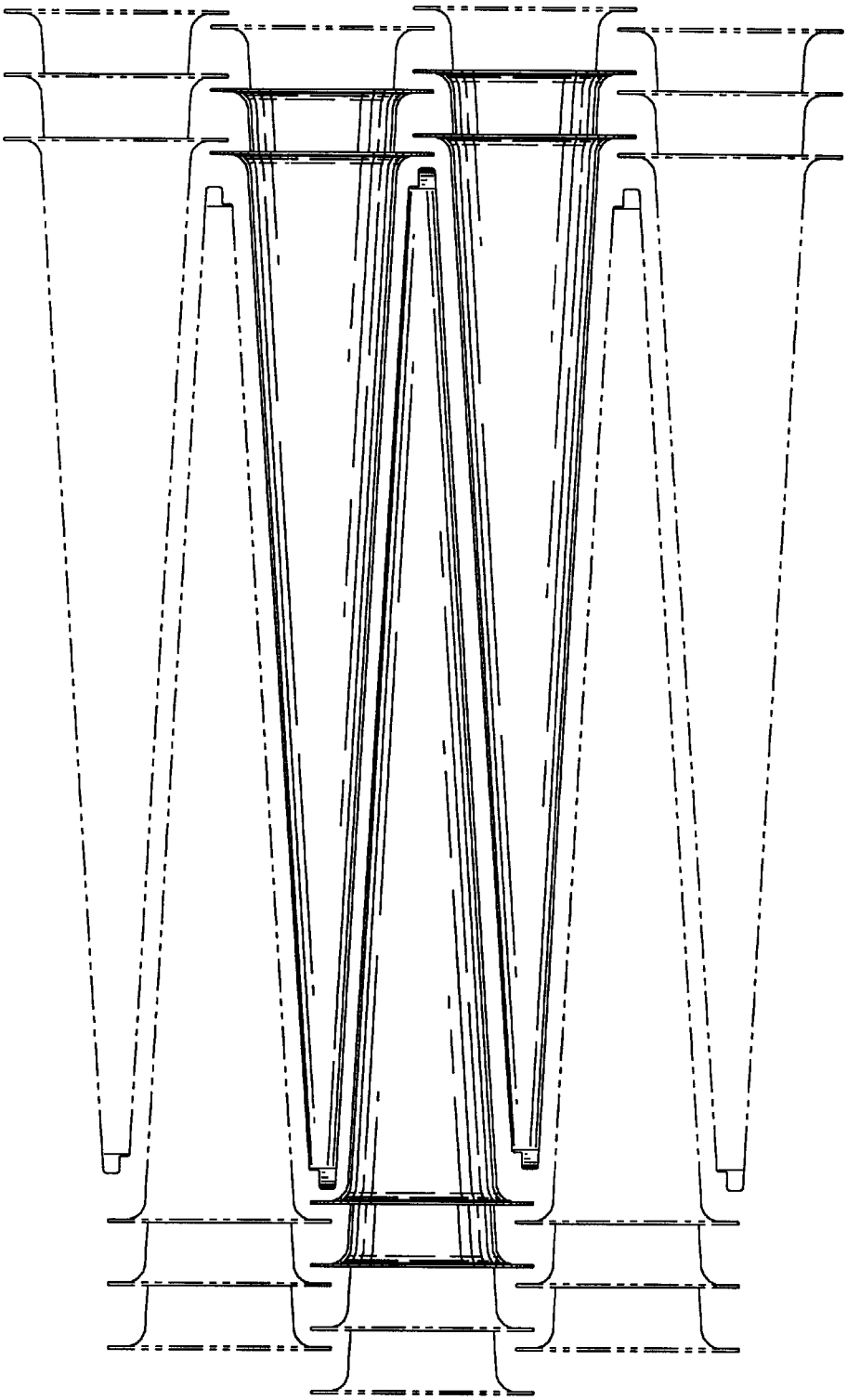
FIG. 11 is an elevation view of a series of interlaced, stacked channelizing devices of FIG. 1.

At present, it is believed that a channelizer 10 with the flat panels 34 and 36 (having recessed areas 39) separated by an included angle $\alpha$ (see FIG. 7) of approximately 7 degrees, the end panels 40 and 42 separated by an included angle $\beta$ (see FIG. 8) of approximately 5.5 degrees, a wall thickness of about 0.125 inches, and a thickness of about 5/8 inch at the very top of the loop handle 30 (that is, not including the thickness of the two end side walls 26) is best. With those design parameters, a channelizer 10 having a height of about 43 inches will be a total of about 1.25 inches thick and about 8.75 inches wide at the top, and will taper to about 6.25 inches thick and about 12.5 inches wide at the bottom of the hollow body 14 (that is, not including the bottom section 16). Applicants have found that with such a design, the channelizers 10 will stack within about 3.33 inches of themselves, resulting in very compact storage without locking of the stacked channelizers. Furthermore, as depicted in FIG. 11, the channelizers 10 may be stacked and then inverted stacked channelizers may be placed into the gaps, resulting in extremely compact and efficient storage of the channelizers of the present invention.

According to a second embodiment of the present invention depicted in FIGS. 14–20, a flat panel traffic channelizing device 100 comprises an upper end 102, a hollow body 104, and a bottom 106 that opens into a central cavity 108 formed by the body 104. The channelizer 100 may be made of different materials and in various colors, including those most common in the current traffic delineation industry. The channelizer 100 is preferably formed by blow molding and subsequent trimming of light weight, resilient plastic, and may include pigments for the desired color, ultraviolet light inhibitors, stabilizers and fillers.

Figure 15:
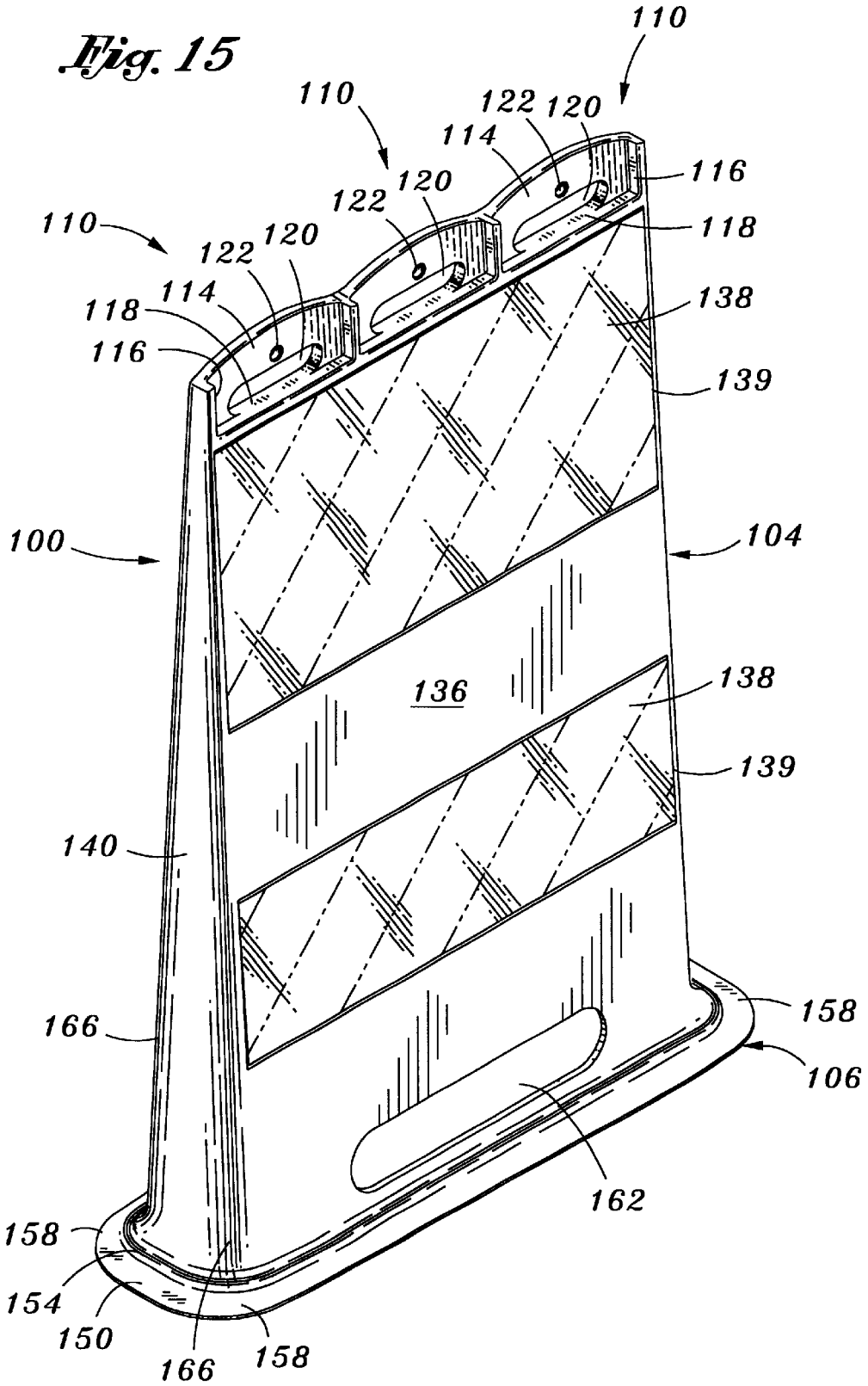
FIG. 15 is a perspective view of a second side view of the channelizing device of FIG. 14.
Figure 16:
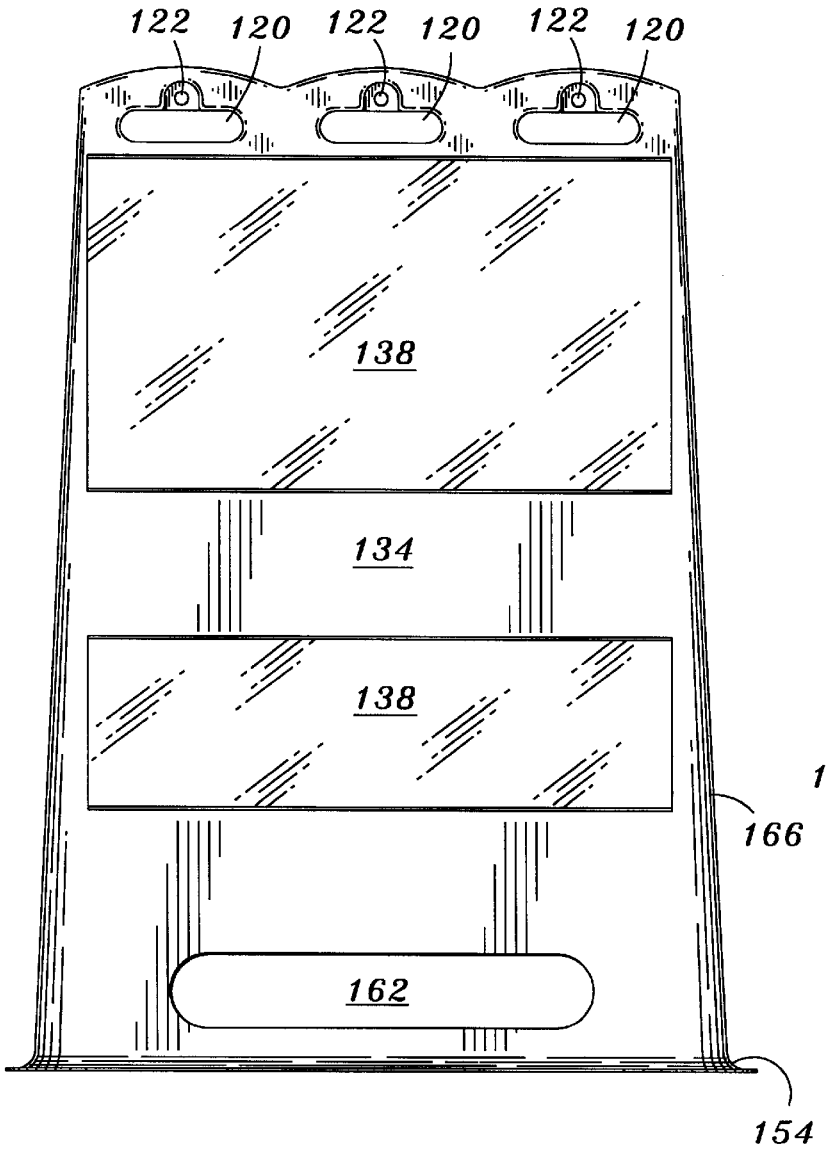
FIG. 16 is a first side elevation view of the channelizing device of FIG. 14.
Figure 17:
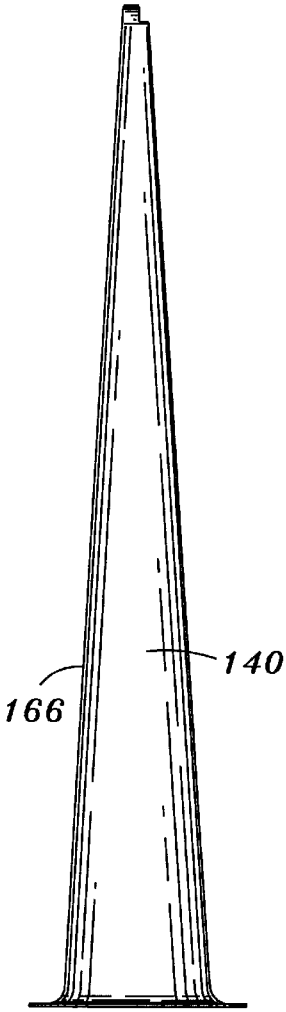
FIG. 17 is an end elevation plan view of the channelizing device of FIG. 14.
Figure 18:
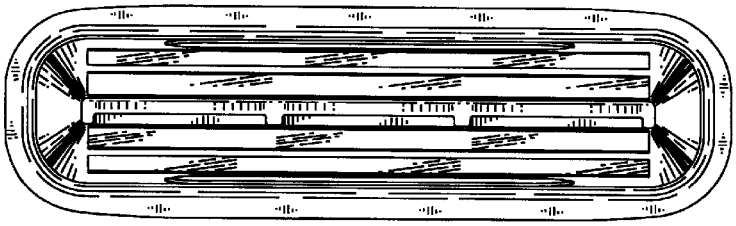
FIG. 18 is a top view of the channelizing device of FIG. 14.
Figure 19:
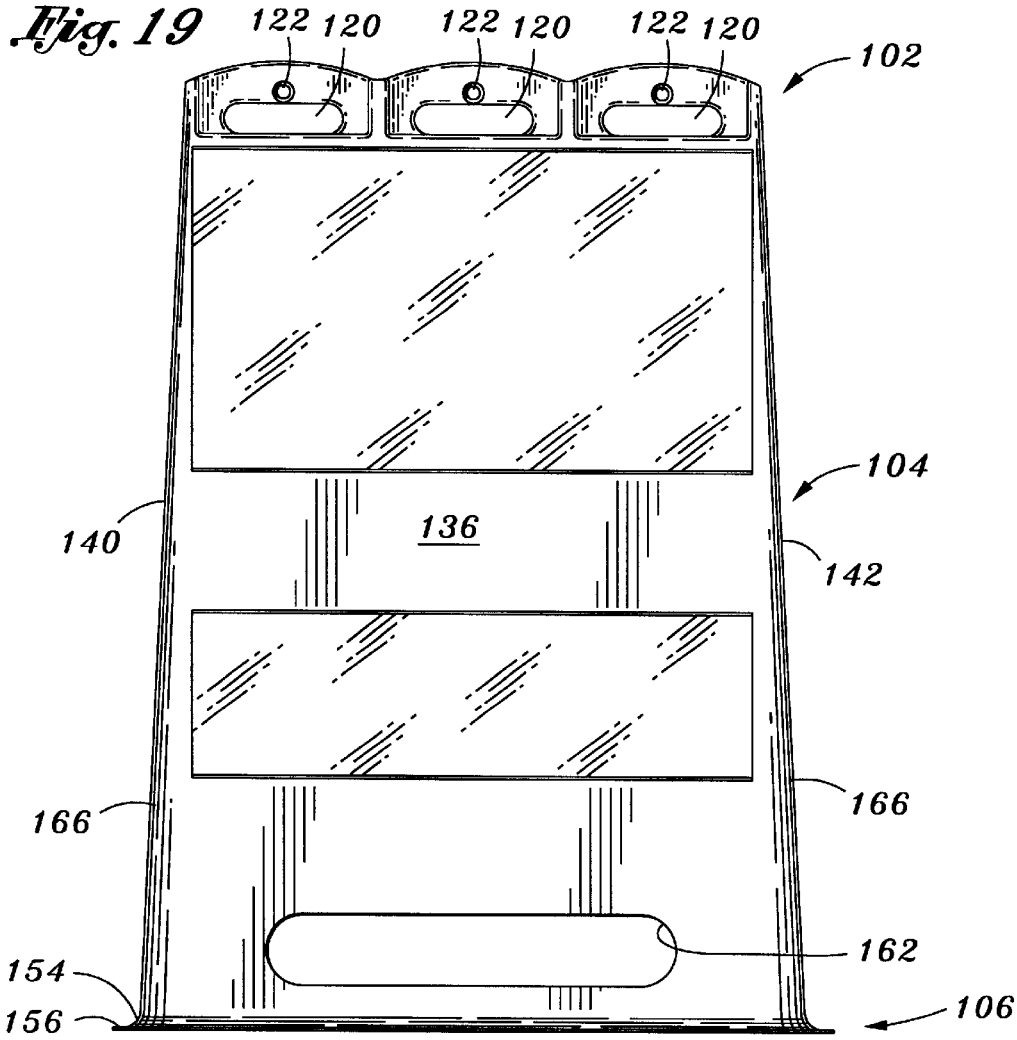
FIG. 19 is a second side elevation view of the channelizing device of FIG. 14.
Figure 20:
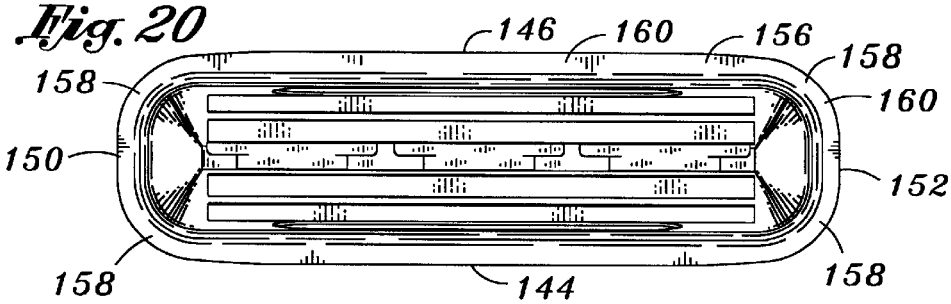
FIG. 20 is a bottom view of the channelizing device of FIG. 14.

As perhaps best depicted in FIG. 15, the upper end 102 of the channelizer 100 forms three brackets 110. Each of those brackets are formed by a flat side wall 114, end side walls 116, and a deck 118 formed at the lower part of the upper end. Three loop handles 120 are formed in the flat side walls 114, near the top of the channelizer 100, and bolt holes 122 are formed above the loop handles. The loop handles 120 and the bolt holes 122 may be formed in the same manner as the loop handle 30 and bolt hole 32.

Figure 14:
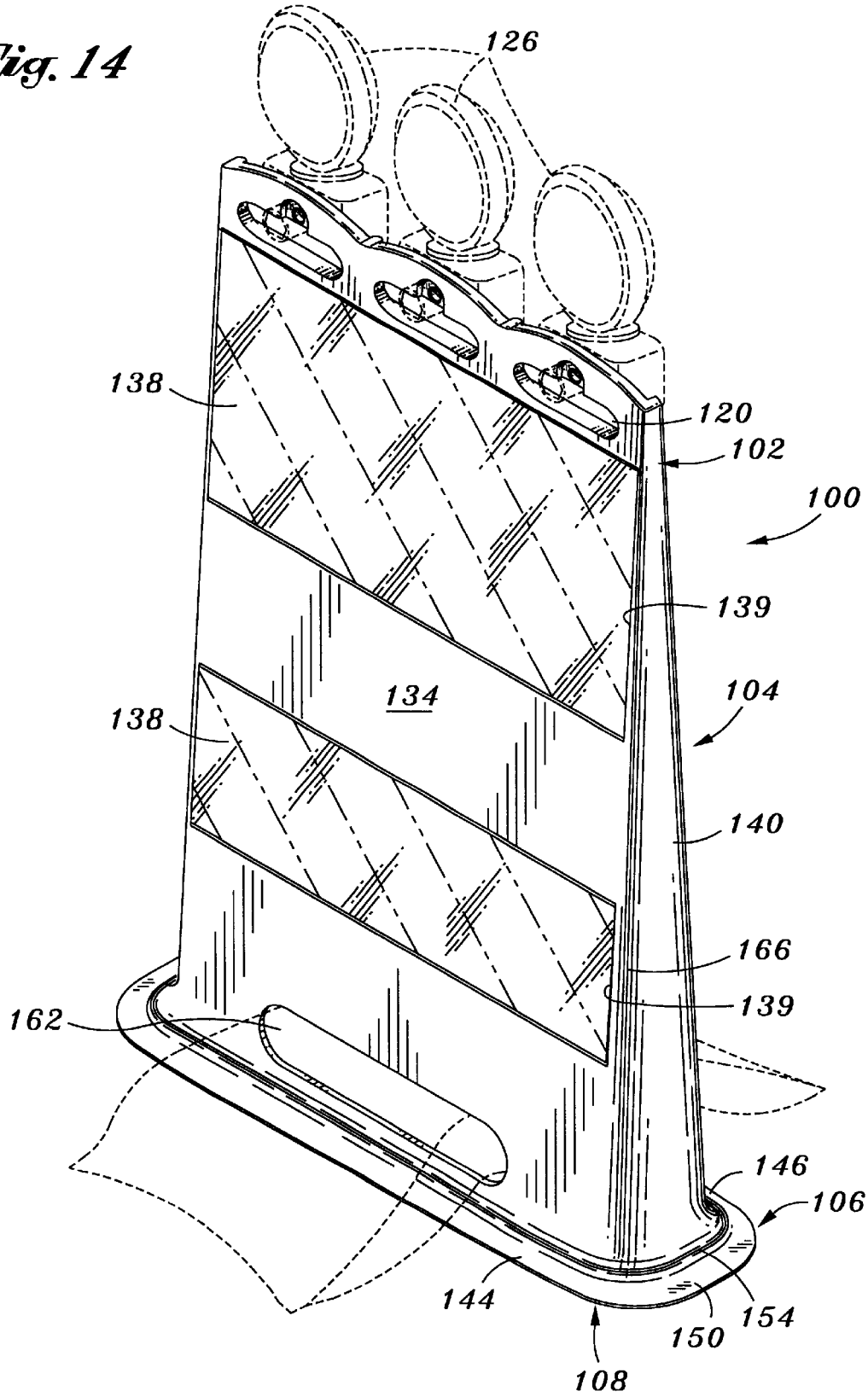
FIG. 14 is a perspective view of a first side of a stackable flat panel traffic channelizing device according to a second embodiment of the present invention.

As depicted in FIG. 14, the brackets 110 are of a size to permit mounting of up to three warning lights 126 on the top of the channelizer 100. Bolts may be passed through the bolt holes 122 to hold the warning lights on the flat side walls 114 of the channelizer 100. The end side walls 116 and the deck 118 prevent the warning lights from rotating. The upper end 102 has a closed top, so there is little need for trimming or cutting during manufacture.

The upper end 102 extends into the body 104 of the channelizer 100. The body 104 comprises a first side flat panel 134 that is connected to a second side flat panel 136 by two end panels 140 and 142. Each of the flat panels is adapted to receive signage or retroreflective sheeting 138, such as in recessed areas 139, and each has the surface area required by state and federal regulations for barricade or flat panel displays.

The body 104 extends into the bottom 106. The generally rectangular bottom 106 is formed of elongated sides 144 and 146 beneath the flat panels 134 and 136 and shorter sides 150 and 152 beneath the end panels 140 and 142. A transition section 154 having a radially inwardly curved wall extends around the circumference of the channelizer. Below the transition section the sides 144,146, 150 and 152 flare outwardly near the lower end of the channelizer 100 to form a road surface engaging portion 156 with rounded outer corners 158 and a flat bottom surface 160. The flaring sides hold the channelizer 100 upright.

Figure 21:
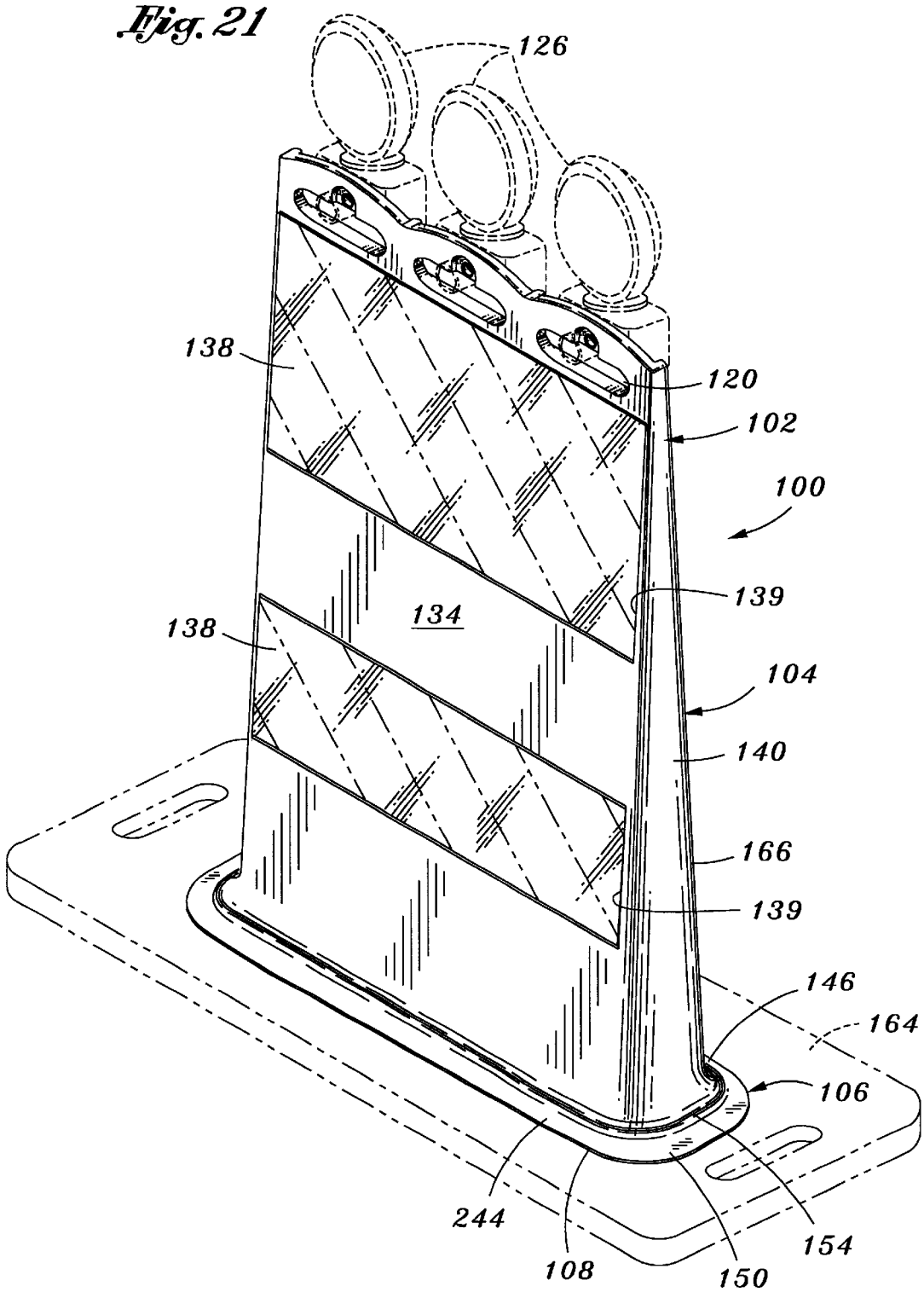
FIG. 21 is a perspective view of a first side of a stackable flat panel traffic channelizing device according to a third embodiment of the present invention.
Figure 22:
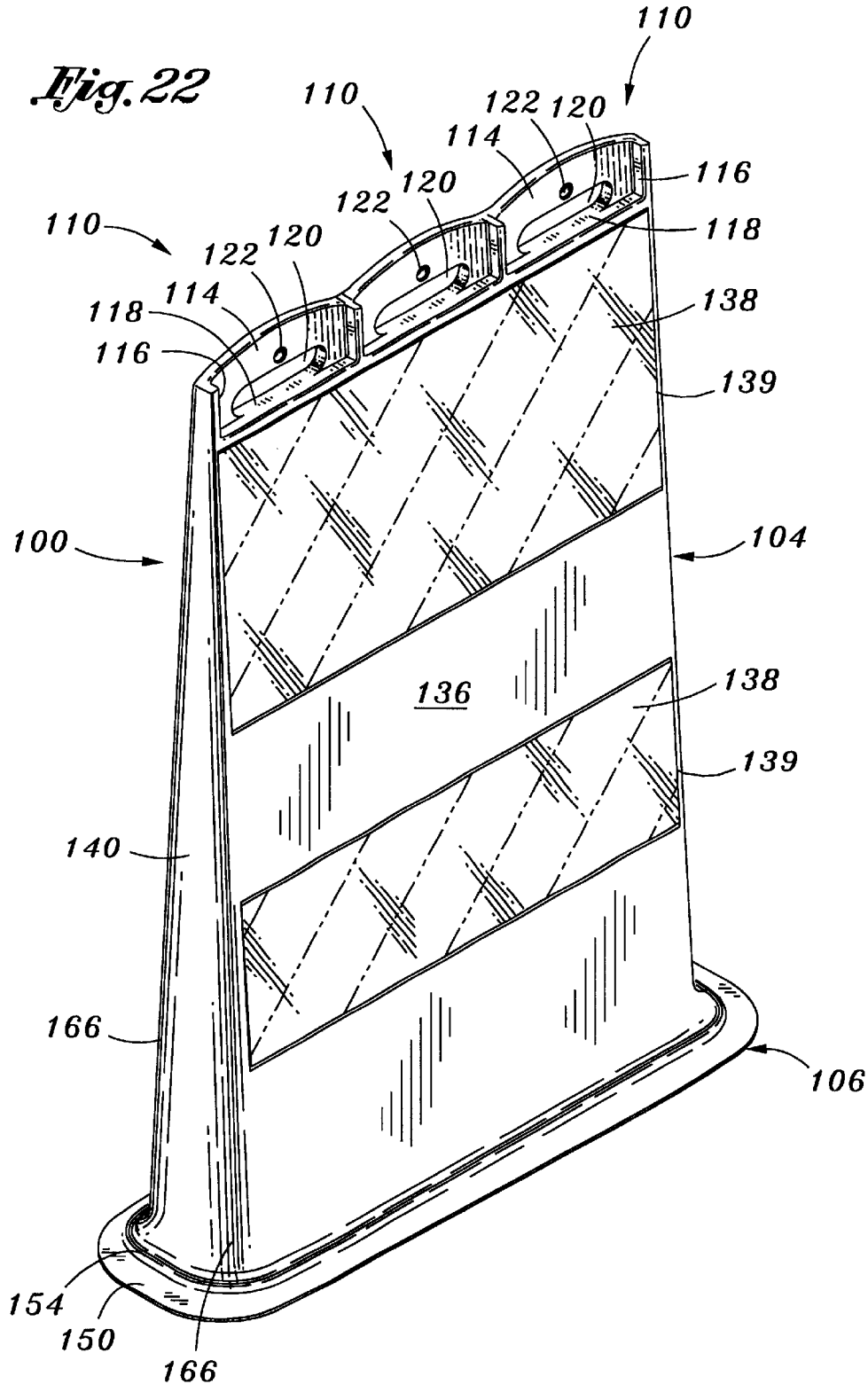
FIG. 22 is a perspective view of a second side of the channelizing device of FIG. 21.

According to one embodiment of the invention, as depicted in FIGS. 14–20, orifices 162 are formed or cut into the lower end of the flat side panels 134 and 136 for receiving a sand bag or other ballasting apparatus. Alternatively, according to a third embodiment of the invention depicted in FIGS. 21 and 22, a drop-over base 164 may be used to ballast the channelizer 100. Again, the base 164 may be any of those known in the art, as was described above with respect to the channelizer 10.

The flat panels 134 and 136 on the body 104 of the channelizer 100 are connected to the end panels 140 and 142 by curved corners 166. As with the channelizer 10, each of these curved corners 166 is basically a quarter of a conical section. The curved corners 166 graduate from a small radius at the top to a large radius at the bottom. In a preferred embodiment of the invention, the radius graduates from a 0.25 inch radius at the top to a four inch radius at the bottom. Thus, the curved corners provide a conical effect to the channelizer 100.

The channelizer 100 has many of the same properties as the channelizer 10. The angle between the flat panels 134 and 136, the wall thickness, and the weight of the channelizer are all important design features for providing a compact stacking channelizer.

According to a fourth embodiment of the present invention depicted in FIGS. 23–26, a flat panel traffic channelizing device 200 comprises an upper end 202, a hollow body 204, and a bottom 206 that opens into a central cavity 208 formed by the body 204. The channelizer 200 may be made of different materials and in various colors, including those most common in the current traffic delineation industry. The channelizer 200 is preferably formed by blow molding and subsequent trimming of light weight, resilient plastic, and may include pigments for the desired color, ultraviolet light inhibitors, stabilizers and fillers.

Figure 23:
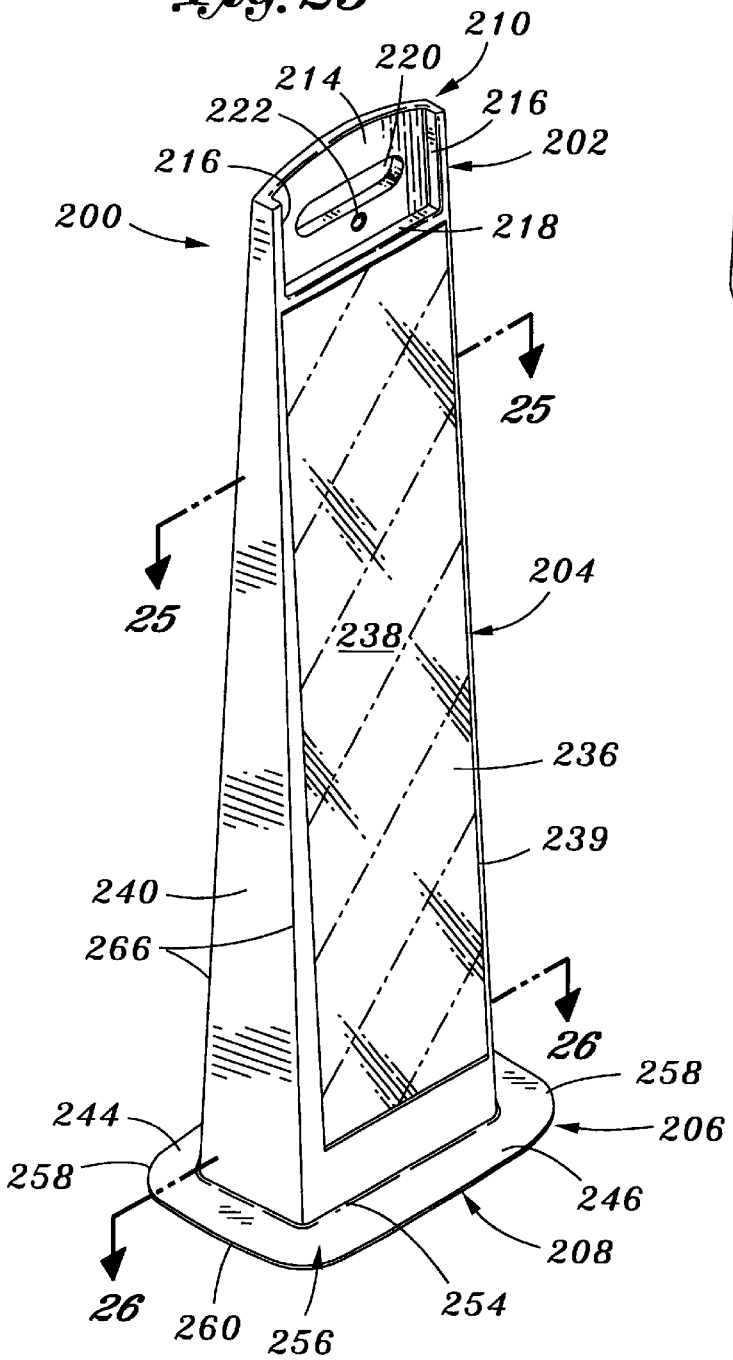
FIG. 23 is a perspective view of a first side of a stackable flat panel traffic channelizing device according to a fourth embodiment of the present invention.
Figure 24:
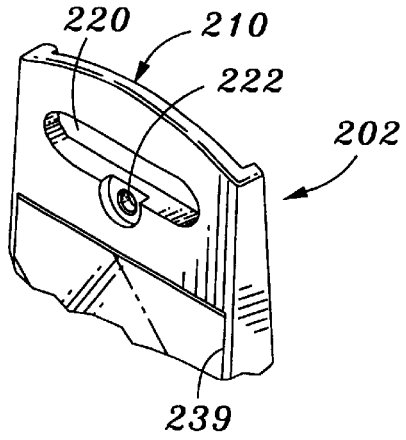
FIG. 24 is a perspective view of the upper portion of a second side of the channelizing device of FIG. 23.
Figure 25:
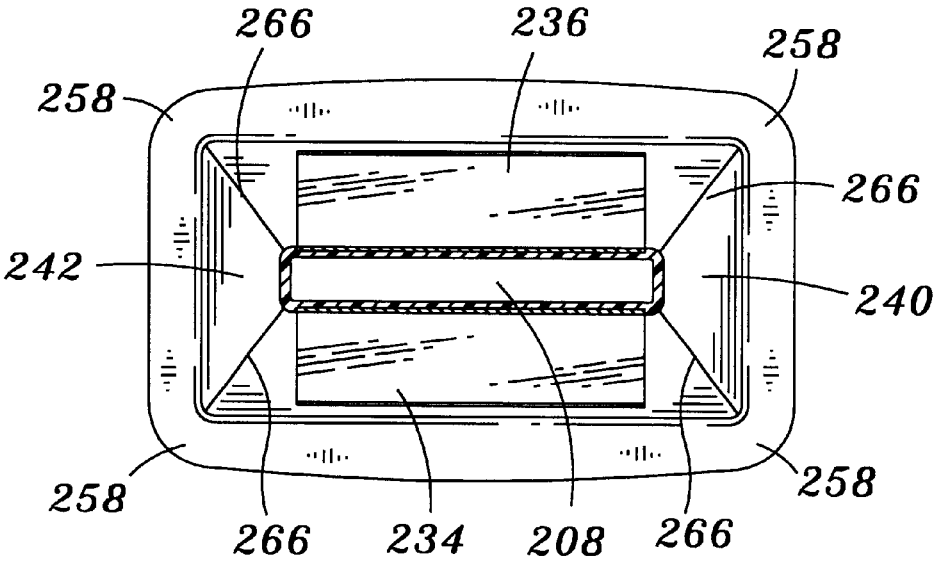
FIG. 25 is a cross-sectional view of the channelizing device of FIG. 23 taken along the line 25—25 of FIG. 23.
Figure 26:
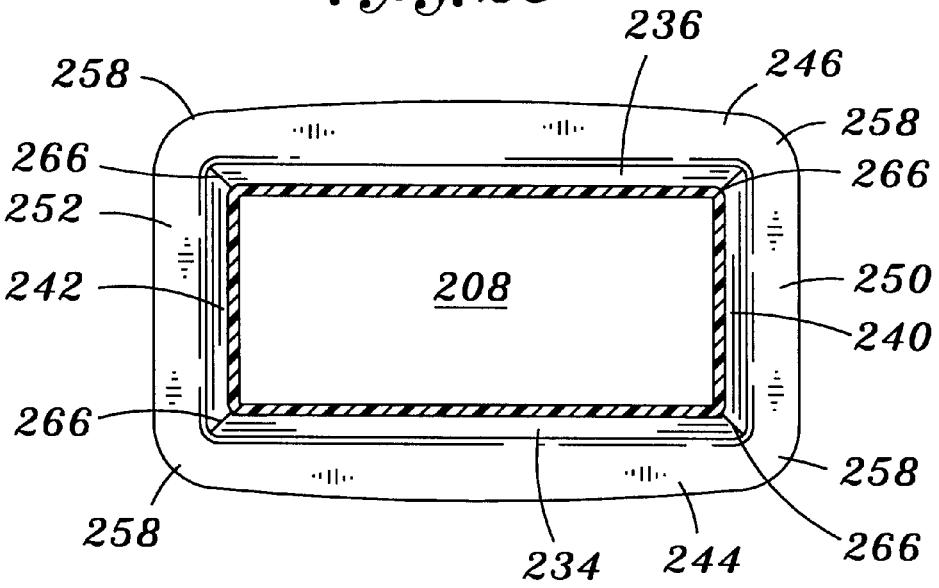
FIG. 26 is a cross-sectional view of the channelizing device of FIG. 23 taken along the line 26—26 of FIG. 23.
Figure 27:
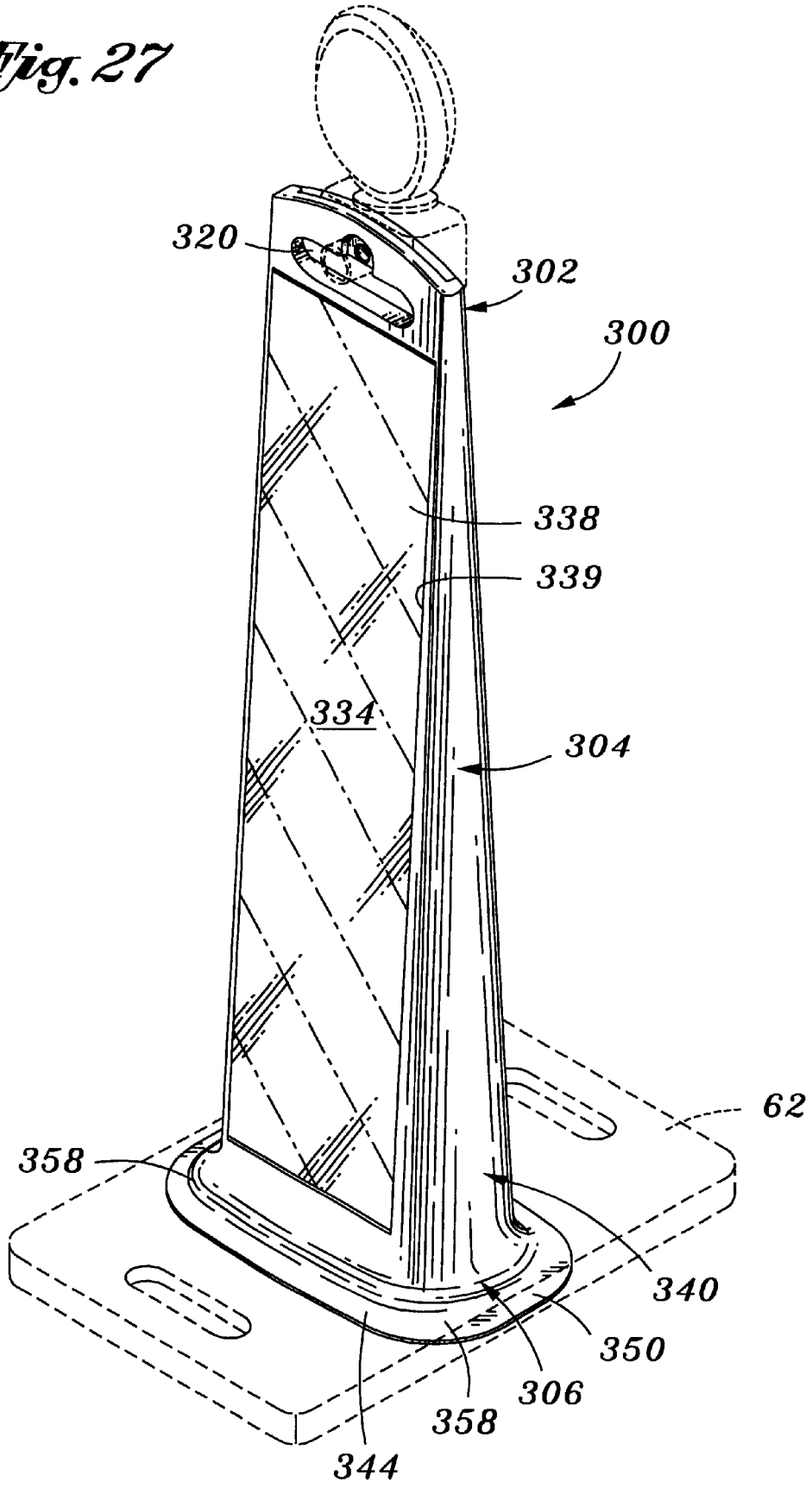
FIG. 27 is a perspective view of a first side of a stackable flat panel traffic channelizing device according to a fifth embodiment of the present invention.

As perhaps best depicted in FIG. 24, the upper end 202 of the channelizer 200 forms a bracket 210. A flat side wall 214, opposing end side walls 216, and a deck 218 form the bracket at the base of the upper end of the channelizing device 200. A loop handle 220 is formed in the flat side wall 214, near the top of the channelizer 200. In the embodiment shown in FIGS. 23–26, a bolt hole 222 is formed below the loop handle. However, the bolt hole could be formed above the loop handle, as depicted in FIG. 1, or the bolt hole could be formed below the loop handle in the other embodiments of the present invention. The loop handle 220 and the bolt hole 222 may be formed in the same manner as the loop handle 30 and bolt hole 32.

The bracket 210 is of a size to permit mounting of warning light on the top of the channelizer 200. A bolt may be passed through the bolt hole 222 to hold the warning light on flat side walls 214 of the channelizer 200. The end side walls 216 and the deck 218 prevent such a warning light from rotating.

The upper end 202 extends into the body 204 of the channelizer 200. The body 204 comprises a first side flat panel 234 that is connected to a second side flat panel 236 by two end panels 240 and 242. Each of the flat panels 234 and 236 is adapted to receive signage or retroreflective sheeting 238, such as in recessed areas 239, and each has the surface area required by state and federal regulations for flat panel displays, which is currently 270 square inches. The flat panels 234 and 236 are generally rectangular in shape. The end panels 240 and 242, however, taper from being wide at the bottom to being narrow at the top, and thus are somewhat triangular in shape.

The body 204 extends into the bottom 206. The generally rectangular bottom 206 is formed of elongated sides 244 and 246 below the flat panels 234 and 236 and shorter sides 250 and 252 below the end panels 40 and 42. A transition section 254 having an inwardly angled wall extends around the circumference of the channelizer. In the fourth embodiment, the transition section has a tight, angled shape, but it could also have the curved shape of the transition section 54 shown in FIG. 1, or the transition section 54 of the first embodiment could be angled as shown in FIG. 23.

Below the transition section the sides 244, 246, 250 and 252 extend outwardly near the lower end of the channelizer 200 to form a road surface engaging portion 256 with rounded outer corners 258 and a flat bottom surface 260. The flaring sides hold the channelizer 200 under a base that may be placed over the channelizer 200, as is known in the art.

In this embodiment of the invention, the flat panels 234 and 236 are connected to the end panels 240 and 242 by angled corners 266. The angled corners have the same small radius at the top as at the bottom. The end panels 240 and 242 have a narrow width near the upper end 202 of the channelizer 200 and a wider width near the bottom 206 of the channelizer 200. This increasing width of the end panels means that the flat panels 234 and 236 are held apart at a predetermined angle. It is presently believed that this angle may be critical to stacking of the channelizers with maximum overlapping to reduce the volume of the stacked channelizers.

According to a fifth embodiment of the present invention depicted in FIGS. 27–30, a flat panel traffic channelizing device 300 comprises an upper end 302, a hollow body 304, and a bottom 306 that opens into a central cavity 308 formed by the body 304. The channelizer 300 may be made of different materials and in various colors, including those most common in the current traffic delineation industry. The channelizer 300 is preferably formed by blow molding and subsequent trimming of light weight, resilient plastic, and may include pigments for the desired color, ultraviolet light inhibitors, stabilizers and fillers.

Figure 28:
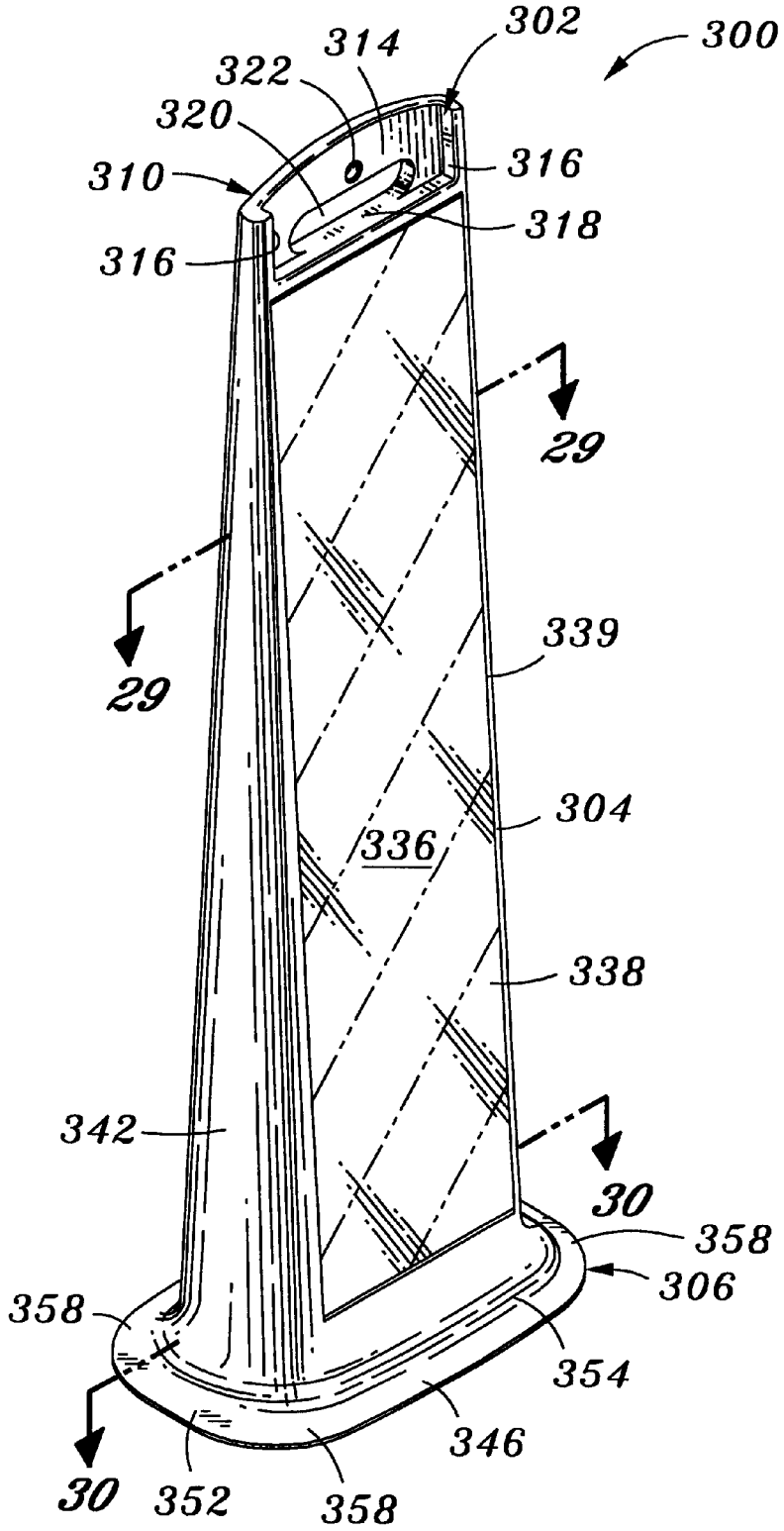
FIG. 28 is a perspective view of a second side view of the channelizing device of FIG. 27.
Figure 29:
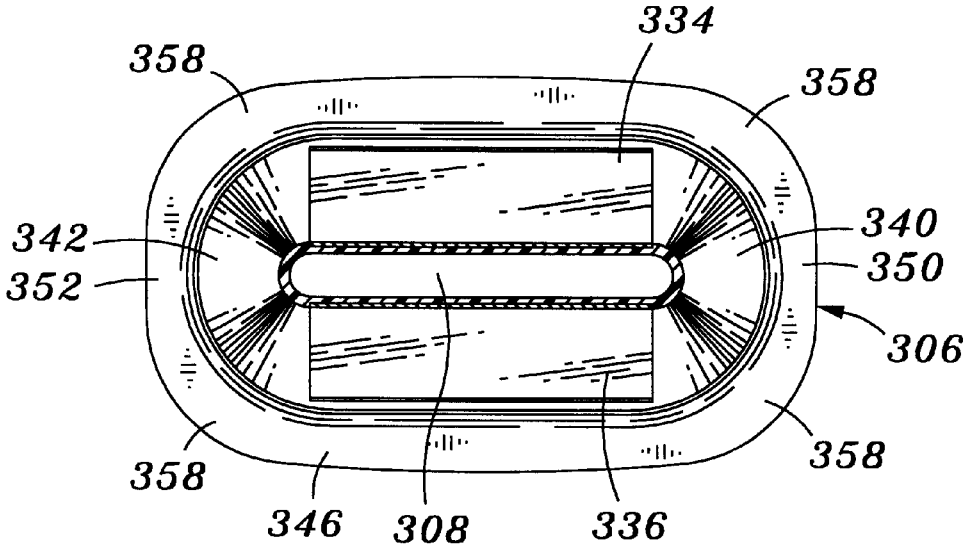
FIG. 29 is a cross-sectional view of the channelizing device of FIG. 27 taken along the line 29—29 of FIG. 28.
Figure 30:
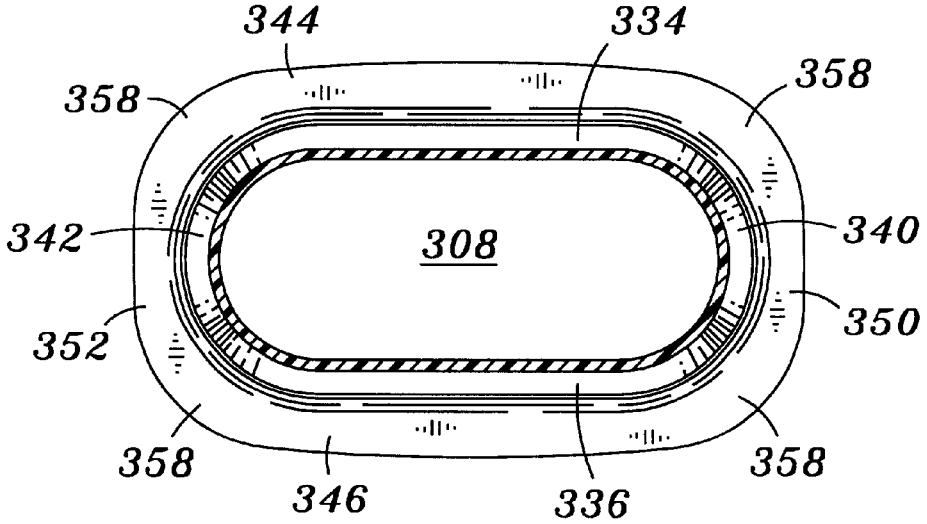
FIG. 30 is a cross-sectional view of the channelizing device of FIG. 27 taken along the line 30—30 of FIG. 28.

As perhaps best depicted in FIG. 28, the upper end 302 of the channelizer 300 forms a bracket 310. A flat side wall 314, opposing end side walls 316, and a deck 318 form the bracket at the base of the upper end of the channelizing device 300. A loop handle 320 is formed in the flat side wall 314, near the top of the channelizer 300. In the embodiment shown in FIGS. 27–30, a bolt hole 322 is formed below the loop handle. However, the bolt hole could be formed above the loop handle. The loop handle 320 and the bolt hole 322 may be formed in the same manner as the loop handle 30 and bolt hole 32.

The bracket 310 is of a size to permit mounting of warning light on the top of the channelizer 300. A bolt may be passed through the bolt hole 322 to hold the warning light on flat side walls 314 of the channelizer 300. The end side walls 316 and the deck 318 prevent such a warning light from rotating.

The upper end 302 extends into the body 304 of the channelizer 300. The body 304 comprises a first side flat panel 334 that is connected to a second side flat panel 336 by curved ends 340 and 342. Each of the flat panels 334 and 336 is adapted to receive signage or retroreflective sheeting 338, such as in recessed areas 339, and each has the surface area required by state and federal regulations for flat panel displays, which is currently 270 square inches. The flat panels 334 and 336 are generally rectangular in shape.

The body 304 extends into the bottom 306. The generally rectangular bottom 306 is formed of elongated sides 344 and 346 below the flat panels 334 and 336 and shorter sides 350 and 352 below the curved ends 340 and 342. A transition section 354 having an inwardly curved wall that extends around the circumference of the channelizer.

Below the transition section the sides 344, 346, 350 and 352 extend outwardly near the lower end of the channelizer 300 to form a road surface engaging portion with rounded outer corners 358 and a flat bottom surface. The flaring sides hold the channelizer 300 under a base that may be placed over the channelizer 300, as is known in the art.

In this embodiment of the invention, the flat panels 334 and 336 are connected to each other by the curved ends 340 and 342, without flat end panels such as end panels 40 and 42. The curved ends 340 and 342 comprise longitudinal conic sections with a radius that tapers from a small radius near the top of the channelizer 300 to a larger radius near the bottom of the channelizer. That is, if the flat panels were removed, the curved ends 340 & 342 would form a cone or, more actually, a frustum because the cone would not end in a point. This increasing radius of the curved ends means that the flat panels 334 and 336 are held apart at a predetermined angle. It is presently believed that this angle may be critical to stacking of the channelizers with maximum overlapping to reduce the volume of the stacked channelizers.

Although several embodiments of the invention have been illustrated and described, various modifications and changes may be made by those skilled in the art without departing from the spirit and scope of the invention.

What is claimed is:

1. A unitary stackable vertical panel channelizing device having a body, a lower portion and an upper portion, the body comprising: first and second generally rectangular flat panels, each flat panel having two opposing elongated edges of a first predetermined length and upper and lower edges of a second predetermined length that is shorter than the first length, each flat panel having an outwardly facing rectangular recessed area formed therein for receiving retroreflective sheeting thereon;

first and second end panels, each end panel having a lower edge of a third predetermined length and two side edges of a fourth predetermined length, which side edges extend generally vertically up toward the upper portion of the channelizing device; and four curved corners, each curved corner connecting a side edge of one end panel to a side edge of one of the flat panels, each curved corner having a predetermined radius proximate the upper portion of the channelizing device that gradually tapers into a second, larger predetermined radius proximate the lower portion of the channelizing device, the curved corners thereby mounting the flat panels in back-to-back relation to each other and separating the flat panels from each other by a predetermined angle;

the lower portion comprising: a generally rectangular bottom section having first and second elongated sides and first and second shorter sides, the bottom section including a road surface engaging portion with rounded outer corners and a flat bottom surface adapted to rest on a road surface; a transition section formed around the circumference of the road surface engaging portion and extending upwardly in a curved wall around the circumference of the bottom section to connect with the body, the lower shorter edge of the first flat panel being connected to a part of the transition section formed on the first elongated side of the bottom section and the lower shorter edge of the second flat panel being connected to a part of the transition section formed on the second elongated side of the bottom section; and the upper portion comprising: a handle; a curved top; and a wall for sealing the top of the channelizing device;

the handle being of a predetermined length and the predetermined angle being such that, when stacked, the channelizing devices do not jam together but are easily unstacked.

2. The traffic channelizing device of claim 1 wherein each of the curved corners comprises a surface constituting one longitudinal quarter of a frustum.

3. The traffic channelizing device of claim 1 further comprising a means for mounting a warning light to the device above the handle.

4. The traffic channelizing device of claim 1 further comprising a means for mounting a warning light to the device below the handle.

5. A unitary stackable vertical panel channelizing device having a body, a lower portion and an upper portion, the body comprising: first and second flat panels, each flat panel having two side edges and upper and lower edges of a first predetermined length; first and second end panels, each end panel having a lower edge and two side edges, which side edges extend generally vertically up toward the upper portion of the channelizing device; and a plurality of curved corner that connect the side edges of each end panel to the side edge of the flat panels, each curved corner having a predetermined radius proximate the upper portion of the channelizing device that gradually tapers into a second, larger predetermined radius proximate the lower portion of the channelizing device.

6. The traffic channelizing device of claim 5 wherein the lower portion comprises: a generally rectangular bottom section having first and second elongated sides and first and second shorter sides, the bottom section including a road surface engaging portion with rounded outer corners and a flat bottom surface adapted to rest on a road surface; and a transition section formed around the circumference of the road surface engaging portion and extending upwardly in a curved wall around the circumference of the bottom section to connect with the body, the lower edge of the first flat panel being connected to a part of the transition section formed on the first elongated side of the bottom section and the lower edge of the second flat panel being connected to a part of the transition section formed on the second elongated side of the bottom section.

7. The traffic channelizing device of claim 5 wherein the upper portion comprises:

a handle;

a curved top;

a means for mounting a warning light; and a wall for sealing the top of the channelizing device.

8. The traffic channelizing device of claim 5 wherein the upper portion comprises a handle and a means for mounting a warning light.

9. The traffic channelizing device of claim 5 wherein the curved corners hold the flat panels in back-to-back relation to each other and separate the flat panels from each other by a predetermined angle.

10. The traffic channelizing device of claim 5 wherein each of the curved corners comprises a surface constituting one longitudinal quarter of a frustum.

11. A vertical panel channelizing device comprising: first and second flat panels, each flat panel having two side edges; first and second end panels, each end panel having two side edges; and a plurality of curved corners, each curved corner connecting a side edge of an end panel to a side edge of a flat panel, each curved corner having a radius that gradually tapers from a relatively smaller radius into a relatively larger radius.

12. The traffic channelizing device of claim 11 further comprising: a bottom section having a road surface engaging portion; and a transition section that connects the bottom section to the flat panels and the end panels.

13. The traffic channelizing device of claim 11 further comprising: a handle; and a means for mounting a warning light.

14. The traffic channelizing device of claim 11 wherein the curved corners hold the flat panels in back-to-back relation to each other and separate the flat panels from each other by a predetermined angle.

15. The traffic channelizing device of claim 11 wherein each of the curved corners form a surface constituting one quarter of a frustum.

16. The traffic channelizing device of claim 13 further comprising a means for mounting a warning light to the device above the handle.

17. The traffic channelizing device of claim 13 further comprising a means for mounting a warning light to the device below the handle.

* * * * *